US008308288B2

(12) United States Patent
Fukui

(10) Patent No.: US 8,308,288 B2
(45) Date of Patent: Nov. 13, 2012

(54) MEDIUM HOLDING APPARATUS AND IMAGE FORMING APPARATUS

(75) Inventor: Takashi Fukui, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 381 days.

(21) Appl. No.: 12/652,529

(22) Filed: Jan. 5, 2010

(65) Prior Publication Data

US 2010/0177152 A1 Jul. 15, 2010

(30) Foreign Application Priority Data

Jan. 7, 2009 (JP) ..... 2009-001699

(51) Int. Cl.
*B41J 2/01* (2006.01)
*B65H 3/14* (2006.01)
*B65H 5/12* (2006.01)

(52) U.S. Cl. ..... 347/104; 347/16; 271/98; 271/276

(58) Field of Classification Search ..... 347/16, 347/101, 104; 271/98, 276
See application file for complete search history.

(56) References Cited

U.S. PATENT DOCUMENTS 5,505,124 A * 4/1996 Esposito ..... 101/142
6,254,092 B1 * 7/2001 Yraceburu et al. ..... 271/276
6,340,155 B1 * 1/2002 Madsen et al. ..... 271/183
7,137,750 B2 * 11/2006 Fujioka et al. ..... 400/642
7,354,147 B2 * 4/2008 Beehler ..... 347/104
8,069,894 B2 * 12/2011 Yamamoto ..... 156/519
8,070,285 B2 * 12/2011 Sawada ..... 347/104
2009/0085947 A1 * 4/2009 Kado et al. ..... 347/16

FOREIGN PATENT DOCUMENTS

JP 9-123395 A 5/1997
JP 11-240133 A 9/1999
JP 2008247522 A * 10/2008

* cited by examiner

*Primary Examiner* — Daniel Petkovsek
(74) *Attorney, Agent, or Firm* — Birch, Stewart, Kolasch & Birch, LLP

(57) ABSTRACT

The medium holding apparatus includes: a medium holding device having a plurality of suction grooves through which a sheet-shaped medium is held by suction; and a suction pressure generating device which is connected to the suction grooves and generates a suction pressure in each of the suction grooves, wherein the suction pressure in one of the suction grooves that holds a first end portion of the sheet-shaped medium is made stronger than the suction pressure in one of the suction grooves that holds a central portion of the sheet-shaped medium.

13 Claims, 14 Drawing Sheets

MEDIUM HOLDING APPARATUS AND IMAGE FORMING APPARATUS

BACKGROUND OF THE INVENTION

1. Field of the Invention

The present invention relates to a medium holding apparatus and an image forming apparatus, and more particularly to a medium holding apparatus suitable for holding and conveying paper in an image forming apparatus such as an inkjet recording apparatus, and an image forming apparatus in which such a medium holding apparatus is employed.

2. Description of the Related Art

As a general image forming apparatus, there is an inkjet recording apparatus, which forms a desired image on a recording medium by ejecting and depositing a plurality of colors of inks onto the recording medium from a plurality of nozzles provided in an inkjet head. The recording media used in the inkjet recording apparatus are not just paper media, but also include media of a plurality of types, such as resin sheet, metal sheet, and the like, and furthermore media of various sizes and thicknesses are used.

A conveyance member which holds and conveys the recording medium has a drum shape or belt shape, or the like. For the method of holding the recording medium, it is suitable to use an air suction method which holds the recording medium by applying a suction pressure (negative pressure) to the recording medium from inside the conveyance member through suction apertures arranged in the surface of the conveyance member.

In the air suction method described above, if the suction pressure is insufficient, then there is a possibility of positional displacement of the recording medium, and if the suction pressure is excessive, then there is a possibility of deformation of the recording medium, or the occurrence of image abnormalities caused by the ink droplets which have been deposited on the recording medium being sucked into the recording medium due to the suction pressure, or the like. Furthermore, if a plurality of suction apertures are provided in accordance with the maximum size so as to achieve compatibility with a plurality of media sizes, and the plurality of suction apertures are suctioned by a common pump, then if there are open suction apertures in cases where a recording medium of small size is used, air might leak through the open suction apertures giving rise to defective holding of the recording medium due to insufficient suction pressure. Consequently, various ways have been devised in order to avoid problems of these kinds.

Japanese Patent Application Publication No. 11-240133 discloses controlling a pressure drum of a printer so that a suction pressure is applied only to suction elements in a range where paper is present.

Japanese Patent Application Publication No. 9-123395 discloses a printer which is made to correspond to different paper sizes by exchanging a porous sheet.

However, a method of holding and securing the recording medium by air suction involves a complex mechanism in order to achieve a high suction pressure. Furthermore, in the related art structure, since the same suction pressure acts on the whole area of the paper, it is necessary to employ a larger suction flow volume in order to secure thick paper, or "stiff" paper. In particular, a strong suction pressure is required in the trailing end portion of the recording medium.

SUMMARY OF THE INVENTION

The present invention has been contrived in view of these circumstances, an object thereof being to provide a medium holding apparatus and an image forming apparatus using same, whereby a stiff medium can be held stably.

In order to attain the aforementioned object, the present invention is directed to a medium holding apparatus, comprising: a medium holding device having a plurality of suction grooves through which a sheet-shaped medium is held by suction; and a suction pressure generating device which is connected to the suction grooves and generates a suction pressure in each of the suction grooves, wherein the suction pressure in one of the suction grooves that holds a first end portion of the sheet-shaped medium is made stronger than the suction pressure in one of the suction grooves that holds a central portion of the sheet-shaped medium.

According to the present invention, by employing a composition which ensures a sucking flow volume that compensates for sucking leakages during a suction action, in the end portions of a medium where such leakage is liable to occur, it is possible to prevent detachment even of a stiff medium from the holding surface of the medium holding device, and therefore the medium can be held in a reliable fashion.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
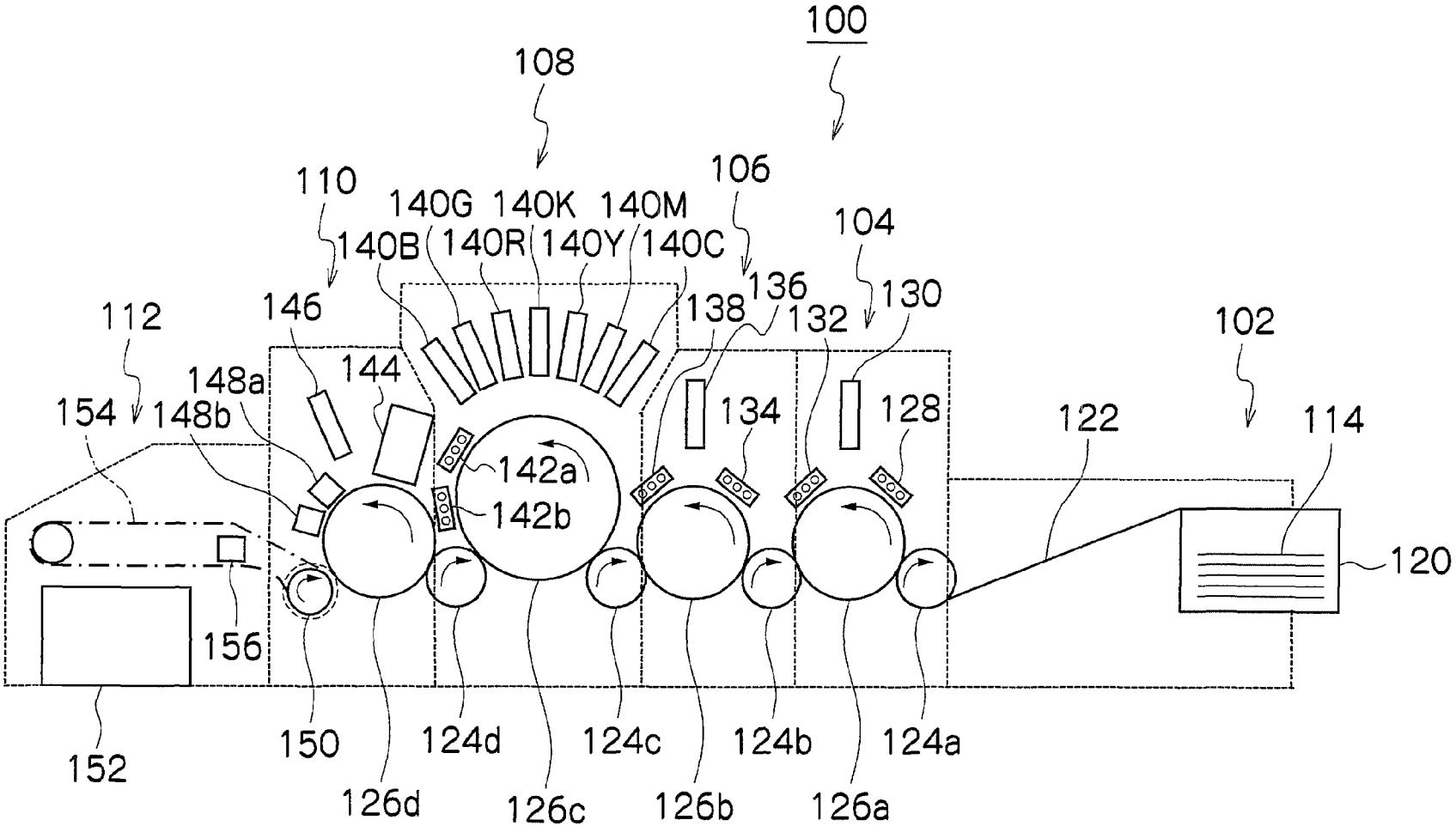
FIG. 1 is a general schematic drawing of an inkjet recording apparatus according to an embodiment of the present invention.

FIG. 1 is a schematic drawing illustrating the general composition of an inkjet recording apparatus 100 according to an embodiment of the present invention. The inkjet recording apparatus 100 shown in FIG. 1 is an image recording apparatus of an on-demand type, which records a desired color image on a surface of a recording medium (e.g., a medium in a sheet shape) 114 by depositing droplets of ink of a plurality of colors onto the surface. More specifically, the inkjet recording apparatus 100 is a recording apparatus which adapts a two-liquids aggregation system that uses the ink and treatment liquid (aggregation treatment liquid) to form images on the recording media (hereinafter also referred to as "paper") 114 such as paper sheets.

The inkjet recording apparatus 100 includes: a paper supply unit 102, which supplies the recording medium 114; a permeation suppression processing unit 104, which carries out permeation suppression processing on the recording medium 114; a treatment agent deposition unit 106, which deposits treatment agent onto the recording medium 114; a print unit 108, which forms an image by depositing the colored inks onto the recording medium 114; a transparent UV ink deposition unit 110, which deposits the transparent UV ink onto the recording medium 114; and a paper output unit 112, which conveys and outputs the recording medium 114 on which the image has been formed.

A paper supply platform 120 on which the recording media 114 are stacked is provided in the paper supply unit 102. A feeder board 122 is connected to the front (the left-hand side in FIG. 1) of the paper supply platform 120, and the recording media 114 stacked on the paper supply platform 120 are supplied one sheet at a time, successively from the uppermost sheet, to the feeder board 122. The recording medium 114 that has been conveyed to the feeder board 122 is supplied to the surface (circumferential surface) of a pressure drum 126*a* of the permeation suppression processing unit 104 through a transfer drum 124*a* capable of rotating in the clockwise direction in FIG. 1.

Grippers 86 (shown in FIG. 11) are arranged on the surface (circumferential surface) of the pressure drum 126*a*, and the grippers 86 serve as holding hooks for holding a leading end portion of the recording medium 114. The recording medium 114 that has been transferred to the pressure drum 126*a* from the transfer drum 124*a* in FIG. 1 is conveyed in the direction of rotation (the counter-clockwise direction in FIG. 1) of the pressure drum 126*a* in a state where the leading end portion is held by the grippers and the medium adheres tightly to the surface of the pressure drum 126*a* (in other words, in a state where the medium is wrapped about the pressure drum 126*a*). A similar composition is also employed for other pressure drums 126*b* to 126*d*, which are described hereinafter.

The permeation suppression processing unit 104 is provided with a paper preheating unit 128, a permeation suppression agent head 130 and a permeation suppression agent drying unit 132 at positions opposing the surface (circumferential surface) of the pressure drum 126*a*, in this order from the upstream side in terms of the direction of rotation of the pressure drum 126*a* (the conveyance direction of the recording medium 114; the counter-clockwise direction in FIG. 1).

The paper preheating unit 128 and the permeation suppression agent drying unit 132 have heaters that can be temperature-controlled within prescribed ranges, respectively. When the recording medium 114 held on the pressure drum 126*a* passes through the positions opposing the paper preheating unit 128 and the permeation suppression agent drying unit 132, it is heated by the heaters of these units.

The permeation suppression agent head 130 ejects droplets of a permeation suppression agent onto the recording medium 114 that is held on the pressure drum 126*a*. The permeation suppression agent head 130 adopts the same composition as ink heads 140C, 140M, 140Y, 140K, 140R, 140G and 140B of the print unit 108, which is described below.

In the present embodiment, the inkjet head is used as the device for carrying out the permeation suppression processing on the surface of the recording medium 114; however, there are no particular restrictions on the device that carries out the permeation suppression processing. For example, it is also possible to use various other methods, such as a spray method, application method, or the like.

In the present embodiment, it is preferable to use a thermoplastic resin latex solution as the permeation suppression agent. Of course, the permeation suppression agent is not limited to being the thermoplastic resin latex solution, and for example, it is also possible to use lamina particles (e.g., mica), or a liquid rappelling agent (a fluoro-coating agent), or the like.

The treatment liquid deposition unit 106 is provided after the permeation suppression processing unit 104 (to the downstream side of same in terms of the direction of conveyance of the recording medium 114). A transfer drum 124*b* is arranged between the pressure drum 126*a* of the permeation suppression processing unit 104 and a pressure drum 126*b* of the treatment liquid deposition unit 106, so as to make contact with same. According to this a structure, after the recording medium 114 held on the pressure drum 126*a* of the permeation suppression processing unit 104 has been subjected to the permeation suppression processing, the recording medium 114 is transferred through the transfer drum 124*b* to the pressure drum 126*b* of the treatment liquid deposition unit 106.

The treatment liquid deposition unit 106 is provided with a paper preheating unit 134, a treatment liquid head 136 and a treatment liquid drying unit 138 at positions opposing the surface of the pressure drum 126*b*, in this order from the upstream side in terms of the direction of rotation of the pressure drum 126*b* (the counter-clockwise direction in FIG. 1).

The respective units of the treatment liquid deposition unit 106 (namely, the paper preheating unit 134, the treatment liquid head 136 and the treatment liquid drying unit 138) use similar compositions to the paper preheating unit 128, the permeation suppression agent head 130 and the permeation suppression agent drying unit 132 of the above-described permeation suppression processing unit 104, and explanation thereof is omitted here. Of course, it is also possible to employ different compositions from the permeation suppression processing unit 104.

The treatment liquid used in the present embodiment is an acidic liquid that has the action of aggregating the coloring materials contained in the inks that are ejected onto the recording medium 114 respectively from the ink heads 140C, 140M, 140Y, 140K, 140R, 140G and 140B disposed in the print unit 108, which is arranged at a downstream stage of the treatment liquid deposition unit 106.

The heating temperature of a heater of the treatment liquid drying unit 138 is set to a temperature that is suitable to dry the treatment liquid having been deposited on the surface of the recording medium 114 by the ejection operation of the treatment liquid head 136 arranged to the upstream side in terms of the direction of rotation of the pressure drum 126*b*, and thereby a solid or semi-solid aggregating treatment agent layer (a thin film layer of dried treatment liquid) is formed on the recording medium 114.

The "solid or semi-solid aggregating treatment agent layer" includes a layer having a water content rate of 0% to 70%, where the water content rate is defined as:

> "Water content rate"="Weight of water contained in treatment liquid after drying, per unit surface area ($g/m^2$)"/"Weight of treatment liquid after drying, per unit surface area ($g/m^2$)".

A desirable mode is one in which the recording medium 114 is preheated by the heater of the paper preheating unit 134, before depositing the treatment liquid on the recording medium 114, as in the present embodiment. In this case, it is possible to restrict the heating energy required to dry the treatment liquid to a low level, and therefore energy savings can be made.

The print unit 108 is arranged at a downstream side of the treatment liquid deposition unit 106. The transfer drum 124*c* capable of rotating in the clockwise direction in FIG. 1 is arranged between the pressure drum 126*b* of the treatment liquid deposition unit 106 and a pressure drum 126*c* of the print unit 108, so as to make contact with same. According to this structure, after the treatment liquid is deposited and the solid or semi-solid aggregating treatment agent layer is formed on the recording medium 114 that is held on the pressure drum 126*b* of the treatment liquid deposition unit 106, the recording medium 114 is transferred through the transfer drum 124*c* to the pressure drum 126*c* of the print unit 108.

The print unit 108 is provided with the ink heads 140C, 140M, 140Y, 140K, 140R, 140G and 140B, which correspond respectively to the seven colors of ink, cyan (C), magenta (M), yellow (Y), black (K), red (R), green (G) and blue (B), and solvent drying units 142*a* and 142*b* at positions opposing the surface of the pressure drum 126*c*, in this order from the upstream side in terms of the direction of rotation of the pressure drum 126*c* (the counter-clockwise direction in FIG. 1).

The ink heads 140C, 140M, 140Y, 140K, 140R, 140G and 104B employ the inkjet type recording heads (inkjet heads), similarly to the permeation suppression agent head 130 and the treatment liquid head 136. The ink heads 140C, 140M, 140Y, 140K, 140R, 140G and 140B respectively eject droplets of corresponding colored inks onto the recording medium 114 held on the pressure drum 126*c*.

Each of the ink heads 140C, 140M, 140Y, 140K, 140R, 140G and 140B is a full-line head having a length corresponding to the maximum width of the image forming region of the recording medium 114 held on the pressure drum 126*c*, and having a plurality of nozzles 161 (shown in FIGS. 12A to 12C) for ejecting the ink, which are arranged on the ink ejection surface of the head through the full width of the image forming region. The ink heads 140C, 140M, 140Y, 140K, 140R, 140G and 140B are arranged so as to extend in a direction that is perpendicular to the direction of rotation of the pressure drum 126*c* (the conveyance direction of the recording medium 114).

According to the composition in which the full line heads having the nozzle rows covering the full width of the image forming region of the recording medium 114 are provided respectively for the colors of ink, it is possible to record an image on the image forming region of the recording medium 114 by performing just one operation of moving the recording medium 114 and the ink heads 140C, 140M, 140Y, 140K, 140R, 140G and 140B relatively with respect to each other (in other words, by one sub-scanning action). Forming an image by the single pass method using the heads of the full line type (page-wide heads) enables faster printing and therefore improves the print productivity than the multi-pass method using the serial (shuttle) type heads moving back and forth reciprocally in the main scanning direction, which is the direction perpendicular to the sub-scanning direction or the conveyance direction of the recording medium 114.

Moreover, although the configuration with the seven colors of C, M, Y, K, R, G and B is described in the present embodiment, the combinations of the ink colors and the number of colors are not limited to those. Light and/or dark inks, and special color inks can be added or removed as required. For example, a configuration is possible in which ink heads for ejecting light-colored inks, such as light cyan and light magenta are added, or a configuration of employing only four colors of C, M, Y and K is also possible. Furthermore, there is no particular restriction on the arrangement sequence of the heads of the respective colors.

Each of the solvent drying units 142*a* and 142*b* has a composition including a heater of which temperature can be controlled within a prescribed range, similarly to the paper preheating units 128 and 134, the permeation suppression agent drying unit 132, and the treatment liquid drying unit 138, which have been described above. As described hereinafter, when ink droplets are deposited onto the solid or semi-solid aggregating treatment agent layer, which has been formed on the recording medium 114, an ink aggregate (coloring material aggregate) is formed on the recording medium 114, and furthermore, the ink solvent that has separated from the coloring material spreads, so that a liquid layer containing dissolved aggregating treatment agent is formed. The solvent component (liquid component) left on the recording medium 114 in this way is a cause of curling of the recording medium 114 and also leads to deterioration of the image. Therefore, in the present embodiment, after depositing the droplets of the colored inks from the ink heads 140C, 140M, 140Y, 140K, 140R, 140G and 140B onto the recording medium 114, heating is carried out by the heaters of the solvent drying units 142*a* and 142*b*, and the solvent component is evaporated off and the recording medium 114 is dried.

The transparent UV ink deposition unit 110 is arranged at a downstream side of the print unit 108. A transfer drum 124*d* capable of rotating in the clockwise direction in FIG. 1 is arranged between the pressure drum 126*c* of the print unit 108 and a pressure drum 126*d* of the transparent UV ink deposition unit 110, so as to make contact with same. Hence, after the colored inks are deposited on the recording medium 114 that is held on the pressure drum 126*c* of the print unit 108, the recording medium 114 is transferred through the transfer drum 124*d* to the pressure drum 126*d* of the transparent UV ink deposition unit 110.

The transparent UV ink deposition unit 110 is provided with a print determination unit 144, which reads in the print results of the print unit 108, a transparent UV ink head 146, and first UV light lamps 148*a* and 148*b* at positions opposing the surface of the pressure drum 126*d*, in this order from the upstream side in terms of the direction of rotation of the pressure drum 126*d* (the counter-clockwise direction in FIG. 1).

The print determination unit 144 includes an image sensor (a line sensor, or the like), which captures an image of the print result of the print unit 108 (the droplet ejection results of the ink heads 140C, 140M, 140Y, 140K, 140R, 140G and 140B), and functions as a device for checking for nozzle blockages, other ejection defects and non-uniformity of the image (density non-uniformity) formed by the droplet ejection, on the basis of the droplet ejection image captured through the image sensor.

The transparent UV ink head 146 employs the same composition as the ink heads 140C, 140M, 140Y, 140K, 140R, 140G and 140B of the print unit 108, and ejects droplets of the transparent UV ink so as to deposit the droplets of the transparent UV ink over the droplets of colored inks having been deposited on the recording medium 114 by the ink heads 140C, 140M, 140Y, 140K, 140R, 140G and 140B. Of course, it may also employ a composition different than the ink heads 140C, 140M, 140Y, 140K, 140R, 140G and 140B of the print unit 108.

The first UV lamps 148*a* and 148*b* cure the transparent UV ink by irradiating UV light onto the transparent UV ink on the recording medium 114 when the recording medium 114 passes the positions opposing the first UV lamps 148*a* and 148*b* after the droplets of the transparent UV ink have been deposited on the recording medium 114.

The paper output unit 112 is arranged at a downstream side of the transparent UV ink deposition unit 110. The paper output unit 112 is provided with a paper output drum 150, which receives the recording medium 114 on which the droplets of the transparent UV ink have been deposited, a paper output platform 152, on which the recording media 114 are stacked, and a paper output chain 154 having a plurality of paper output grippers, which is spanned between a sprocket arranged on the paper output drum 150 and a sprocket arranged above the paper output platform 152.

A second UV lamp 156 is arranged at the inner side of the paper output chain 154 between the sprockets. The second UV lamp 156 cures the transparent UV ink by irradiating UV light onto the transparent UV ink on the recording medium 114, by the time that the recording medium 114 having been transferred from the pressure drum 126*d* of the transparent UV ink deposition unit 110 to the paper output drum 150 is conveyed by the paper output chain 154 to the paper output platform 152.

Description of Medium Holding Device for Holding and Conveying Medium

Next, the structure of the pressure drums 126*a* to 126*d*, which convey the recording medium 114 in the prescribed direction while holding the recording medium 114, will be described in detail. Since the pressure drums 126*a* to 126*d* have a common structure for holding the recording medium 114, then a conveyance drum (corresponding to "a medium holding device") 10 is described below as a general representation of the pressure drums 126*a* to 126*d*.

Figure 2:
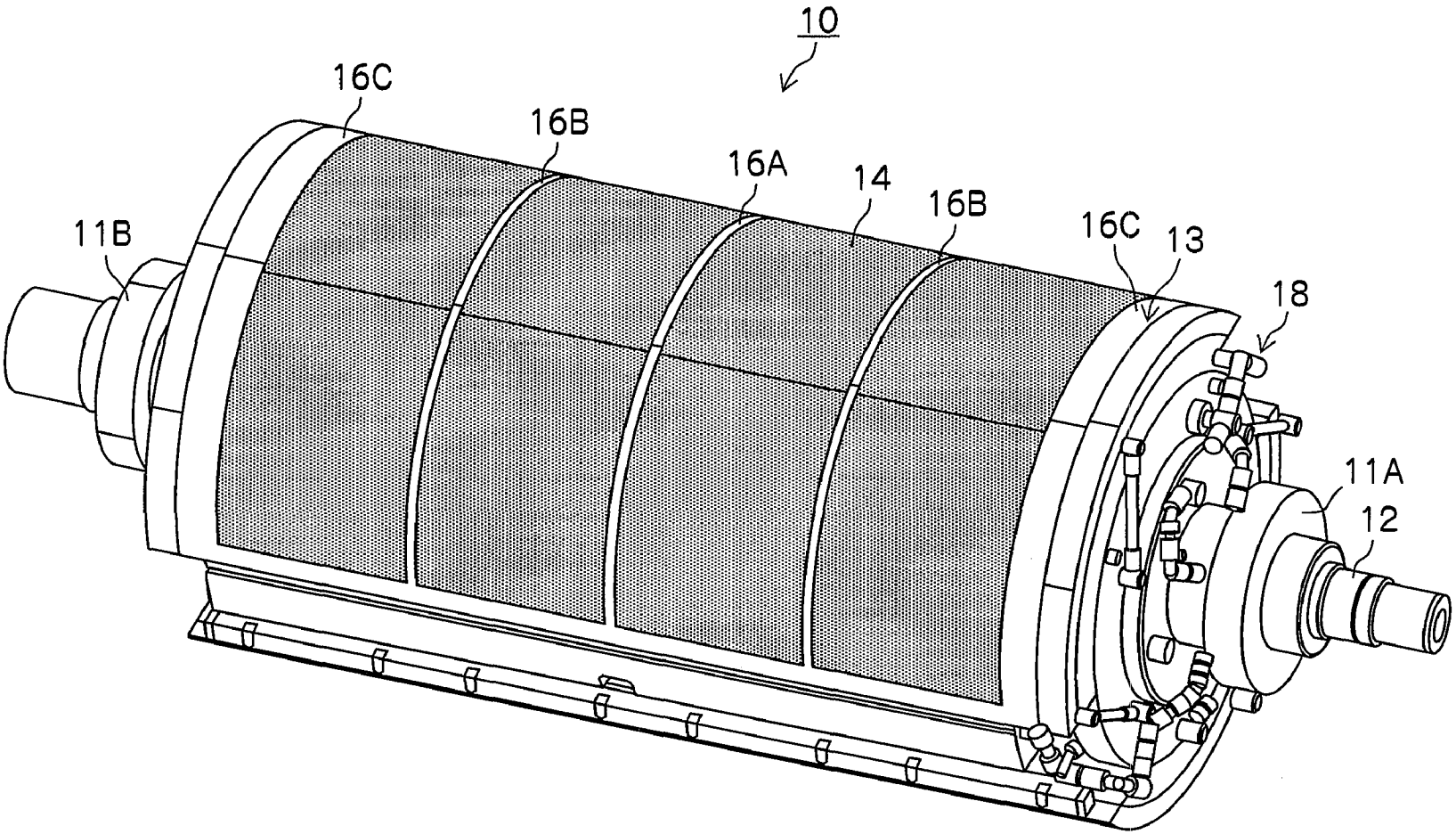
FIG. 2 is a perspective diagram showing the approximate structure of a conveyance drum.

FIG. 2 is a perspective diagram showing the overall structure of the conveyance drum 10. As shown in FIG. 2, the conveyance drum 10 is a rotating member which is coupled to a rotation mechanism (not shown) and is composed so as to be rotatable about a rotating axle 12 supported on bearings 11A and 11B, due to the operation of the rotation mechanism.

Medium suction regions 14 (dot-hatched regions in FIG. 2) are provided on a medium holding surface (circumferential surface) 13 of the conveyance drum 10 on which the recording medium 114 (see FIG. 1) is held (secured), and a plurality of suction apertures (openings) are provided in the medium suction regions 14. For the sake of convenience, FIG. 2 does not depict the respective suction apertures in the medium suction regions 14, but in FIGS. 7 to 10 the suction apertures are denoted with reference numeral 70 or 70'.

On the other hand, in FIG. 2, closed portions 16A, 16B and 16C where no suction apertures are disposed are provided in a band shape of uniform width following the circumferential direction of the conveyance drum 10, in the approximate central portion (16A) of the conveyance drum 10 in the axial direction thereof (the direction parallel to the rotating axle 12, hereinafter referred to as the "drum axial direction"), at positions (16B) approximately ¼ of the drum length to the left and right from the center of the conveyance drum 10, and also at the left-hand and right-hand end portions (16C) of the conveyance drum 10. These closed portions 16A, 16B and 16C correspond to the positions of the drum suction grooves 26 formed in the drum main body 30, which are described hereinafter (see FIG. 3), and are provided so as to close off the rear sides of restrictor sections 52 and 62 of the suction grooves (50, 60) which are formed in the rear surface of the suction sheet 20 (see FIGS. 4 to 8). Below, where necessary, the closed portions 16A, 16B and 16C may be denoted with the reference numeral 16.

A vacuum flow channel for suction which connects to the suction apertures of the medium suction regions 14 is provided inside the conveyance drum 10 shown in FIG. 2, and this vacuum flow channel is connected to a vacuum pump (not shown in FIG. 2, and depicted as a suction pressure generating device denoted with reference numeral 196 in FIG. 14) provided to the exterior of the conveyance drum 10, through a vacuum piping system 18 (including tubes, joints, and the like) provided on the side face of the conveyance drum 10, and through a vacuum flow channel provided inside the rotating axle 12 of the conveyance drum 10. When a vacuum (negative pressure) is generated by operating the vacuum pump, a suction pressure is applied to the recording medium 114 through the suction apertures, the vacuum flow channel, and the like. In other words, the conveyance drum 10 is composed in such a manner that the recording medium 114 is held on the circumferential surface which forms the medium holding surface 13, by means of the air suction system.

Figure 3:
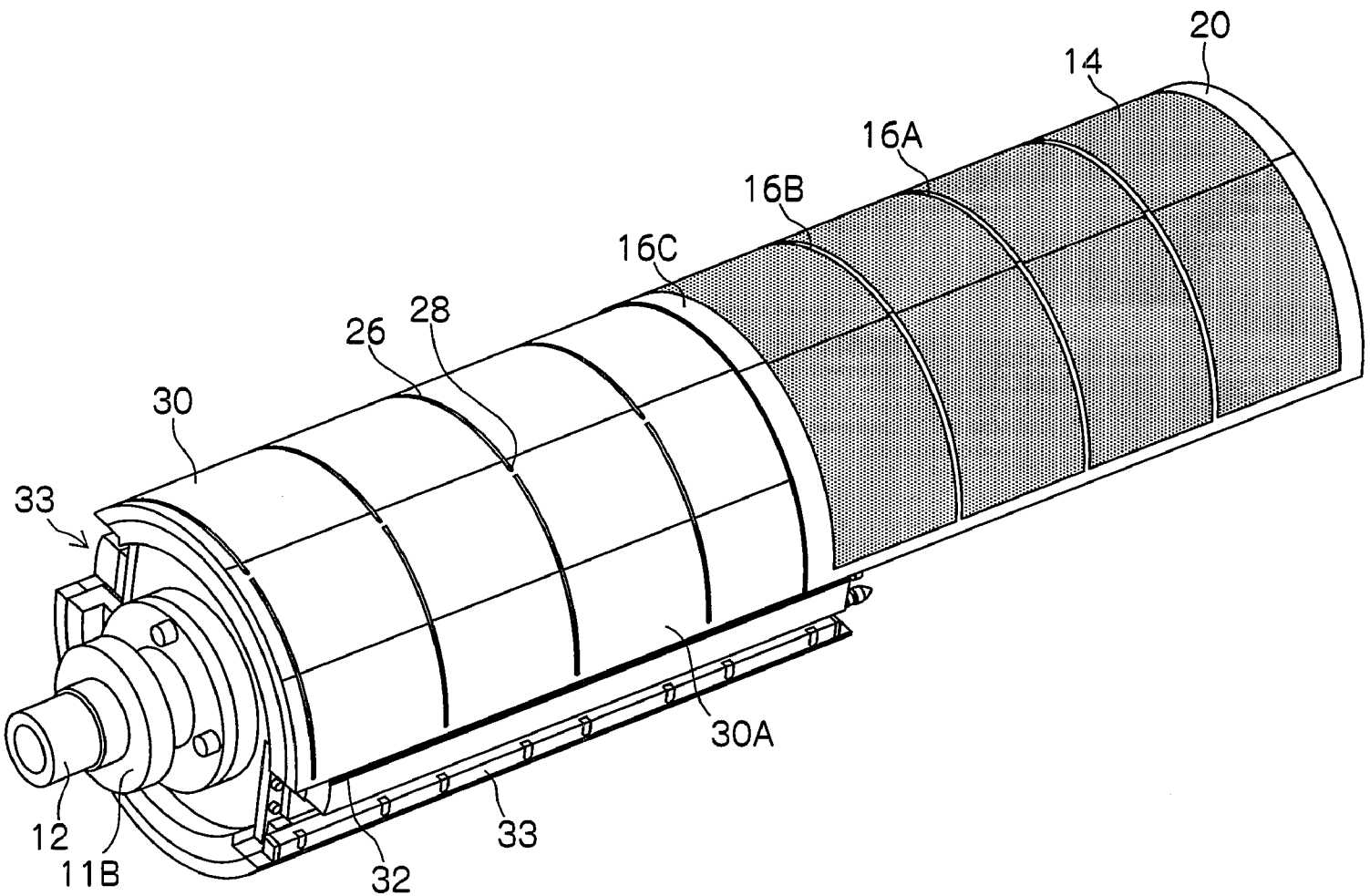
FIG. 3 is an exploded perspective diagram showing the internal structure of the conveyance drum shown in FIG. 2.

FIG. 3 is an exploded perspective diagram showing the internal structure of the conveyance drum 10. The conveyance drum 10 includes a suction sheet 20 having a plurality of suction apertures formed in the surface thereof, and a drum main body 30 having drum suction grooves 26 (corresponding to "suction flow channels") which connect with the restrictor sections 52 and 62 (see FIG. 4) of suction grooves 50 and 60 (see FIG. 4) formed in the rear surface of the suction sheet 20. Drum suction apertures 28 which are connected to the vacuum flow channel (not shown) provided inside the drum main body 30 are disposed in the end portions of the drum suction grooves 26 which are provided on the circumferential surface of the drum main body 30.

Structure of Drum Main Body

Next, the structure of the drum main body 30 will be described in detail.

The drum suction grooves 26 are provided on the circumferential surface 30A of the drum main body 30, along the circumferential direction of the drum (i.e., the conveyance direction of the recording medium 114) perpendicular to the drum axial direction, so as to correspond to the full circumference of the drum main body 30.

The drum main body 30 in the present embodiment is divided in the circumferential direction. More specifically, if the drum corresponds to the transfer drums 124*a* to 124*d* in FIG. 1, then it is divided into two regions, and if the drum corresponds to the pressure drums 126*a* to 126*d*, then it is divided into two or three regions. Each of the divided regions has a similar structure, and here one of the divided regions will be described.

The drum main body 30 shown in FIG. 3 corresponds to the transfer drums 124*a* to 124*d* in FIG. 1, and the plurality of drum suction grooves 26 are provided respectively in different positions in the drum axial direction (five positions in the present embodiment: namely the center, respective ends and intermediate positions between the center and ends), in respect of each of the two divided regions which are divided in the circumferential direction. In FIG. 3, the drum suction grooves 26 at the right-hand end of the drum are not depicted, but the drum suction grooves 26 are provided also at the right-hand end of the drum similarly to the left-hand end of the drum.

In the case of FIG. 3, two drum suction grooves 26 which are divided in two in the circumferential direction are provided in each of the five positions in the drum axial direction, and therefore a total of ten (10=5×2) drum suction grooves 26 are provided in one divided region. Since the similar composition is adopted through the whole circumference of the drum main body 30 and there are two divided regions, a total of twenty (20) drum suction grooves 26 are provided.

Each of the drum suction apertures 28 is provided at one end of each of the drum suction grooves 26, and the drum suction grooves 26 are connected through the drum suction apertures 28 to the vacuum flow channel (not shown) provided inside the drum main body 30. The vacuum flow channel is connected to a vacuum pump (not shown) through the vacuum piping system 18, which is provided on the side face of the drum main body 30, and the vacuum flow channel provided inside the rotating axle 12.

The drum main body 30 is provided with a grooved structure (a gripping and holding section for holding the suction sheet) 32 and a tensioning mechanism 33 on the circumferential surface 30A of the drum main body 30. The grooved structure 32 grips a fold structure (L-shaped bend structure) provided on the suction sheet 20 when holding the suction sheet 20. The tensioning mechanism 33 is disposed on the opposite side of the drum main body 30 from the gripping and holding section 32, and applies tension to the suction sheet 20 in the circumferential direction in a state where the fold structure (L-shaped structure) of the suction sheet 20 is gripped.

The gripping and holding section 32 and the tensioning mechanism 33 of the drum main body 30 may have any structure which enables them to hold the suction sheet 20 shown in FIG. 2 in a state where the suction sheet 20 is in tight contact with the circumferential surface 30A. The conveyance drum 10 in the present embodiment has the prescribed vacuum flow channels arranged about the full circumference of the conveyance drum 10 by arranging two suction sheets 20 aligned in the circumferential direction. In other words, two pairs of the gripping and holding sections 32 and the tensioning mechanisms 33 are provided in two mutually opposing positions in the circumferential direction.

Composition of Suction Sheet

Figure 4:
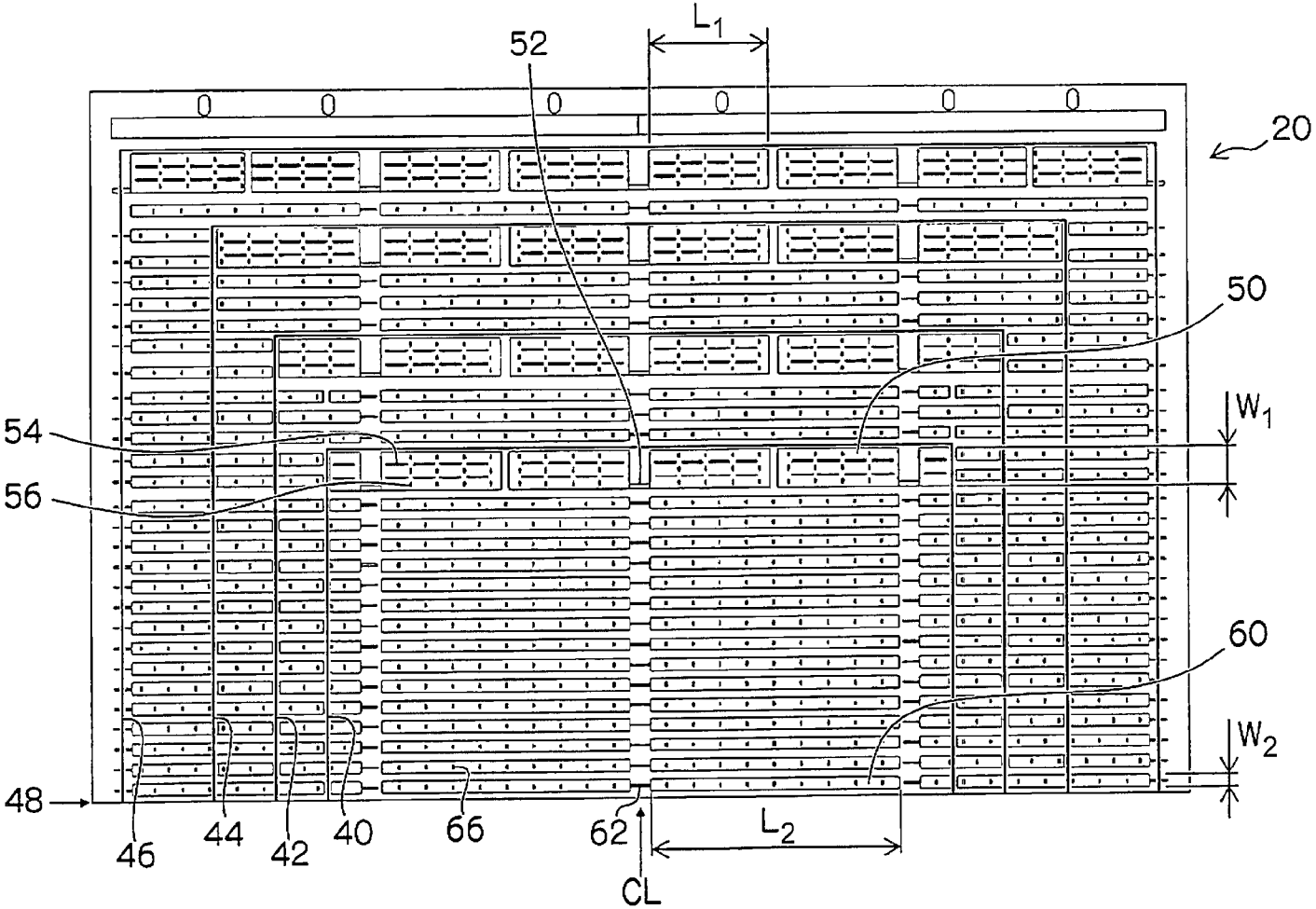
FIG. 4 is a plan diagram of the rear surface of a suction sheet.
Figure 5:
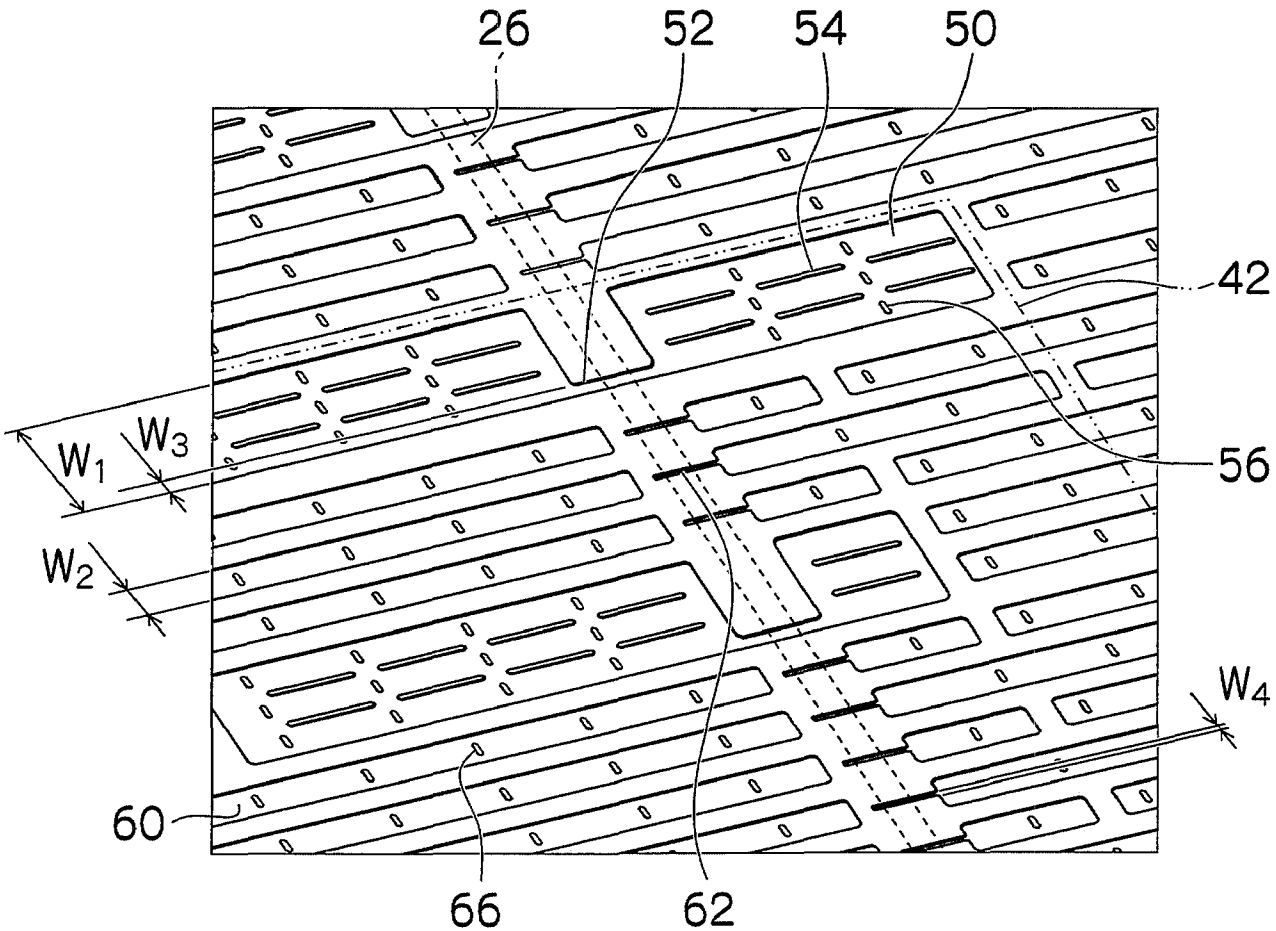
FIG. 5 is a partial enlarged view of FIG. 4.

FIG. 4 is a plan diagram of the rear surface of the suction sheet 20, and FIG. 5 is a partial enlarged view of FIG. 4. In FIGS. 4 and 5, in order to simplify the drawings, the suction apertures are not depicted and only the pattern of the rear surface of the suction sheet 20 is shown.

Rectangular regions surrounded by thick lines denoted with reference numerals 40, 42, 44 and 46 in FIG. 4 represent the respective suction positions for different sizes of the recording media. The region denoted with the reference numeral 40 corresponds to the quarter Kiku size (469 mm×318 mm), the region denoted with the reference numeral 42 corresponds to the quarter Shiroku size (545 mm×394 mm), the region denoted with the reference numeral 44 corresponds to the half Kiku size (636 mm×469 mm), and the region denoted with the reference numeral 46 corresponds to the half EU size (520 mm×720 mm).

In FIG. 4, the lower edge (denoted with reference numeral 48) of the suction sheet 20 is the position where the leading edge of the recording medium is placed, and the center line (CL) of the suction sheet 20 in the drum axial direction is the position where the center of the recording medium is placed. The recording medium (not shown) is held by suction on the front surface side of the suction sheet 20 in the positional relationship shown in FIG. 4.

As shown in FIG. 4, the suction grooves 50 and 60 connected to the respective suction apertures (not shown) are arranged in accordance with a prescribed arrangement pattern corresponding to the plurality of different sizes of recording media, on the rear surface side of the suction sheet 20. FIG. 4 shows an embodiment of a pattern of suction grooves 50 and 60 following the drum axial direction; however, the shape of the grooves and the arrangement (pattern) of the grooves are not limited to the present embodiment, and the shape, length, groove direction, number and arrangement of the suction grooves 50 and 60 are designed in accordance with the size of the recording medium.

In the suction sheet 20 of the present embodiment, the groove width $W_1$ of the suction grooves 50 (hereinafter referred to as the "first suction grooves 50") through which the trailing end portion of the recording medium is held by suction is greater than the groove width $W_2$ of the suction grooves 60 (hereinafter referred to as the "second suction grooves 60") through which the central portion of the recording medium (the inside portion apart from the end portions of the paper) is held by suction (i.e., $W_1>W_2$), and the length of the first suction grooves 50 (the length in the drum axial direction from the restrictor section 52) $L_1$ is shorter than the groove length $L_2$ of the second suction grooves 60 (i.e., $L_1<L_2$).

The end portion of each of the first suction grooves 50 has the restrictor section 52 (corresponding to a "flow volume control section") having a smaller flow channel cross-sectional area than the other portions of the groove (the portions having groove width of $W_1$). In the present embodiment, a narrow-width flow channel section (see FIG. 5) having a groove width $W_3$ which is formed extending from the end portion of the first suction groove 50 functions as the restrictor section 52. The restrictor section 52 has a structure (restricting structure) in which the groove width is narrowed to ¼ or less of the width of the other portions (the portions of groove width $W_1$) (i.e., $W_3 \leqq W_1/4$).

In the central portion (CL) in the drum axial direction of the suction sheet 20, two first suction grooves 50 which share one restrictor section 52 are disposed separately to the left-hand side and right-hand side of the restrictor section 52 as shown in FIG. 4, and these two first suction grooves 50 aligned in the drum axial direction are connected together through the common restrictor section 52.

Similarly, the restrictor sections 62 having the smaller flow channel cross-sectional area than the other portions (the portions of groove width $W_2$) are formed in the second suction grooves 60 which are disposed in the position where a portion of the recording medium other than the trailing end portion (and principally, the central portion of the recording medium) is held by suction. As shown in FIG. 5, in the present embodiment, the restrictor section 62 has a structure (restricting structure) where the groove width $W_4$ narrows to ¼ or less of that in the other portions (the portions of groove width of $W_2$) (i.e., $W_4 \leqq W_2/4$).

In FIG. 5, the portion indicated by the broken lines and denoted with reference numeral 26 represents the position of the drum suction groove 26 (see FIG. 3). In this way, the restrictor sections 52 and 62 have a structure where the restrictor sections 52 and 62 are connected to the drum suction grooves 26 shown in FIG. 3, and the opening sections on the medium holding surface 13 are closed off by the closed portions 16 of the suction sheet 20 and are not open directly to the outside air.

Desirably, the groove widths $W_3$ and $W_4$ of the restrictor sections 52 and 62 are not smaller than 0.2 mm and not greater than 5.0 mm, and more desirably, not smaller than 1.0 mm and not greater than 3.0 mm. Furthermore, it is desirable that the lengths of the restrictor sections 52 and 62 in the drum axial direction are not smaller than 2.0 mm and not greater than 10.0 mm.

In the present embodiment, the restrictor sections 52 of the first suction grooves 50 are the groove sections where the flow channel cross-sectional area is greater than the restrictor sections 62 of the second suction grooves 60 (i.e., $W_3>W_4$). A mode where the suction flow volume of the restrictor sections 52 of the first suction grooves 50 is made greater than the suction flow volume of the restrictor sections 62 of the second suction grooves 60 is not limited to the mode where the groove width $W_3$ is widened as in FIGS. 4 and 5 so that the flow channel cross-sectional area is made greater, and instead of this or in combination with this, it is also possible to adopt a mode in which the length $L_3$ of the restrictor sections 52 is shortened as in FIG. 6 and/or a mode in which the depth of the restrictor sections 52 is deepened.

According to the composition described with reference to FIGS. 4 to 6, it is possible to make the sucking flow volume (suction flow volume) per unit length of the first suction grooves 50 which are disposed in the portion corresponding to the trailing end portion of the paper, greater than the sucking flow volume (suction flow volume) per unit length of the second suction grooves 60 which are disposed in the portion corresponding to the central portion of the paper, and hence the suction pressure at the trailing end portion of the paper can be increased. Consequently, it is possible to hold stiff paper, such as thick paper, by suction more efficiently.

Air leaks are liable to occur during sucking, in the trailing end portion of the paper. On the other hand, leaks of this kind are not liable to occur in the grooves (the second suction grooves 60) of the central portion (inner side) of the paper. Consequently, a desirable mode is one which employs a groove structure in which the width $W_1$ of the first suction grooves 50 is widened and the cross-sectional area of the restrictor sections 52 is raised, so as to be able to ensure the suction flow volume required in the vicinity of the trailing end portion of the paper.

Moreover, in the suction sheet 20 according to the present embodiment, island-shaped ribs 54 and 56 having projecting shapes are arranged in the middle of the first suction grooves 50. The heights of the ribs 54 and 56 are roughly the same as the depth of the first suction grooves 50. The ribs 54 in a row are arranged separately from each other in a line parallel to the drum axial direction. The lengthwise direction of each rib 54 is also parallel to the drum axial direction. Further, a plurality of rows of ribs 54 (rib rows) are arranged inside the same first suction groove 50 (in FIG. 4, there are two rib rows in each first suction groove), and the ribs 54 are arranged separately from each other in lines parallel to the drum axial direction in the rows. The distance between the rib rows is substantially equal to the groove width $W_2$ of the second suction grooves 60.

Furthermore, the ribs 56 in a row are arranged separately from each other in a line perpendicular to the drum axial direction, in the interspace between the ribs 54 adjacent to each other in the drum axial direction. The lengthwise direction of each rib 56 is also perpendicular to the drum axial direction.

By providing respectively divided island-shaped ribs 54 and 56 in this way, it is possible to prevent indentations in the arched surface of the recording medium 114 held by suction on the suction sheet 20 and therefore a uniform throw distance can be maintained. Furthermore, since air is able to move through the gaps between the separated island-shaped ribs 54 and 56, then it is possible to ensure the flow volume of air in the first suction grooves 50. In other words, it is possible to supply a greater flow volume from the other portions of the grooves, in response to leaks occurring at a particular position in a first suction groove 50.

Supposing that the ribs 54 and 56 were not provided inside the grooves, then when the recording medium is held by suction, indentations would occur in the regions of the suction sheet 20 corresponding to the first suction grooves 50. Furthermore, if the ribs 54 were joined together and formed in a single continuous line shape, then the interior space of the first suction grooves 50 would be divided up and the grooves would effectively become equivalent to narrow-width flow channel grooves (the flow channel cross-sectional area of the first suction grooves 50 becomes effectively smaller). Therefore, it would become impossible to ensure the required sucking flow volume.

From the viewpoint of preventing indentations of the recording medium as described above and to ensure the required flow volume, a desirable mode is one where the island-shaped ribs 54 and 56 are formed inside the grooves. The arrangement direction and configuration of the ribs are not limited in particular, and the ribs may also be arranged in a configuration arranged obliquely to the drum axial direction.

For similar reasons to the foregoing, the island-shaped ribs 66 are also arranged at suitable intervals in the drum axial direction, in the second suction grooves 60 which are long in the drum axial direction.

Moreover, the length $L_1$ of the broad-width first suction grooves 50 corresponding to the trailing end portion of the paper is approximately half the length $L_2$ of the second suction grooves 60 through which the central portion of the paper is held by suction. In this way, by adopting the composition in which the length $L_2$ is divided in two in the trailing end portion of the paper and two of the first suction grooves 50 having each length of $L_1$ from the restrictor section 52 are arranged in the drum axial direction, it is possible to ensure sufficient suction force even in the portions furthest distanced from the restrictor sections 52.

In the description given above, the viewpoint of improving the suction force to the trailing end portion of the paper has been described, and as is clear from the drawing in FIG. 4, increase in the suction force compared to the central portion of the paper can be achieved by adopting a structure for the suction grooves corresponding to the left-hand and right-hand end portions of the paper and the corner portions of the paper.

Structure of Flow Channels in Conveyance Drum

As described in FIGS. 2 to 6, the conveyance drum 10 according to the present embodiment has the structure in which the drum suction grooves 26 of the drum main body 30 and the restrictor sections 52 and 62 on the rear surface of the suction sheet 20 are registered in position, and the suction sheet 20 is wrapped about the circumferential surface of the drum main body 30 and held in tight contact with same.

Figure 7:
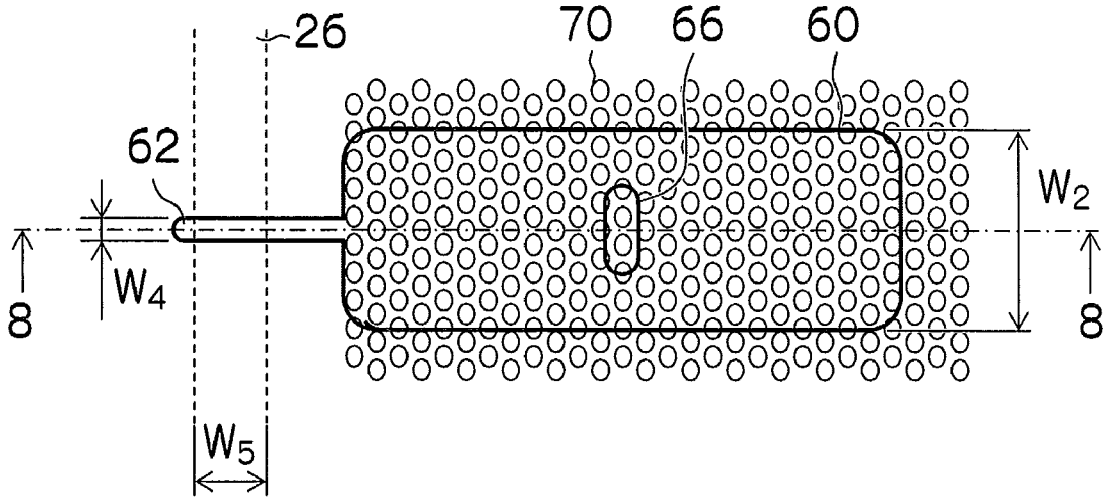
FIG. 7 is a partially enlarged diagram of the conveyance drum shown in FIG. 2.
Figure 8:
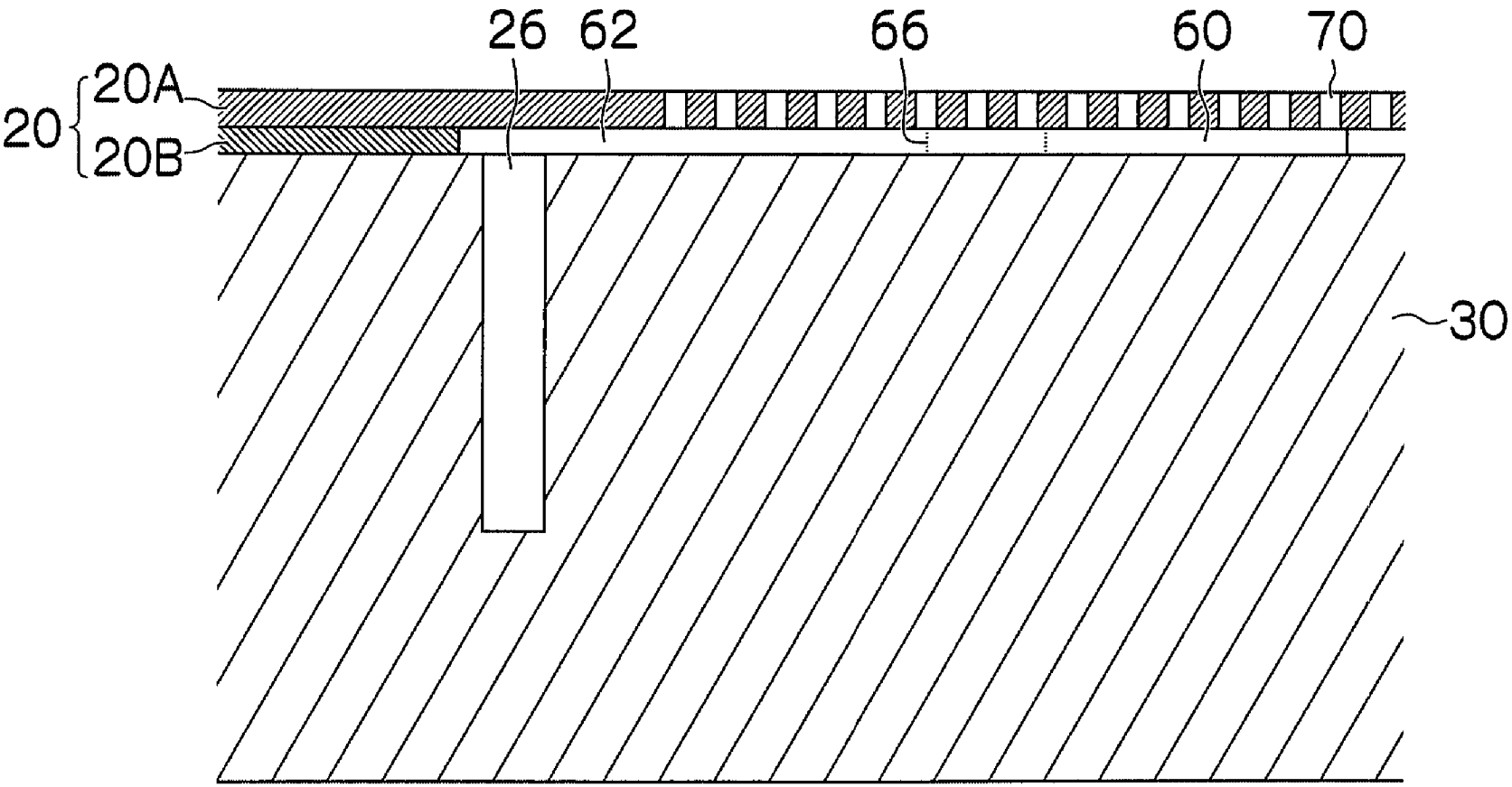
FIG. 8 is a cross-sectional diagram along line 8-8 in FIG. 7.

FIGS. 7 and 8 show the arrangement relationship between the suction apertures 70 and the suction grooves 60 of the suction sheet 20 and the drum suction grooves 26. FIG. 7 is a plan diagram, and FIG. 8 is a cross-sectional diagram along line 8-8 in FIG. 7. However, FIG. 8 shows an enlarged view in the depth direction in order to aid understanding. Here, the second suction grooves 60 having the narrow groove width are described as an example, but the similar structure also applies to the first suction grooves 50.

It is desirable that the arrangement pattern of the suction apertures 70 arranged in the suction sheet 20 corresponds to the pattern of the suction grooves (50 or 60) in the rear surface; however, it is possible that there are some apertures 70 which are not connected to the suction grooves (50 or 60).

As shown in FIG. 7, the width (the dimension in the vertical direction in FIG. 7) $W_2$ of the second suction grooves 60 is a dimension corresponding to a plurality of suction apertures 70, and FIG. 7 shows a mode where the width of the suction grooves 60 is approximately seven times the diameter (the dimension in the major axis) of the suction apertures 70.

Furthermore, the width (the dimension in the horizontal direction in FIG. 7) $W_5$ of the drum suction grooves 26 is shorter than the length of the restrictor sections 62, and FIG. 7 shows a mode where the width $W_5$ of the drum suction grooves 26 is approximately ½ of the length of the restrictor sections 62. Moreover, the restrictor sections 62 have a length to reach a position beyond the drum suction grooves 26.

As shown in FIG. 7, the width $W_4$ of the restrictor sections 62 is narrower than the width $W_2$ of the second suction grooves 60, and the depth of the restrictor sections 62 and the depth of the second suction grooves 60 are substantially the same (see FIG. 8). In other words, the flow channel cross-sectional area of the restrictor sections 62 is smaller than the flow channel cross-sectional area of the second suction grooves 60, and hence the flow volume of air flowing in the second suction grooves 60 is restricted by the restrictor sections 62.

Furthermore, the suction sheet 20 according to the present embodiment has a suction aperture forming layer 20A where the suction apertures 70 are formed in the front surface side which makes contact with the paper, and a flow channel groove forming layer 20B on the rear surface side which makes contact with the drum main body 30 (see FIG. 8). The thickness of the suction aperture forming layer 20A is greater than the thickness of the flow channel groove forming layer 20B. FIG. 8 shows a mode where the thickness of the flow channel groove forming layer 20B is substantially ½ the thickness of the suction aperture forming layer 20A.

Figure 6:
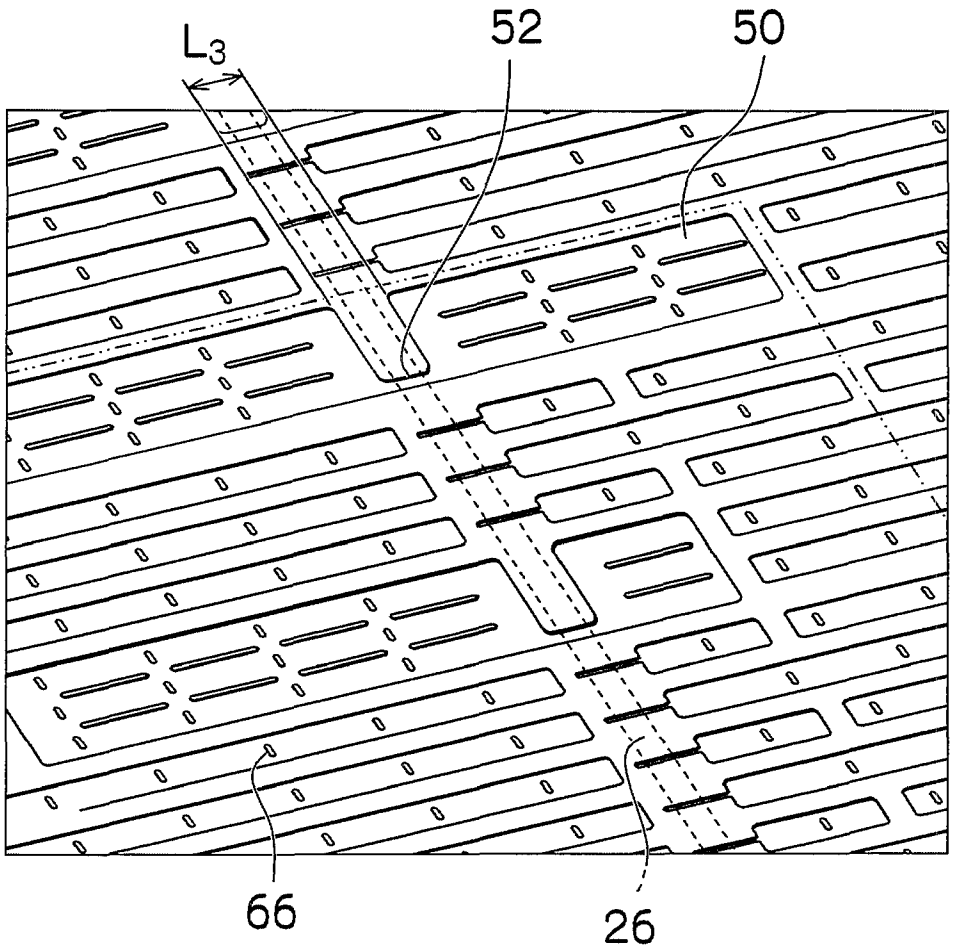
FIG. 6 is a diagram showing a further embodiment of the shape of grooves formed in the suction sheet.

The flow channel groove forming layer 20B is a portion of a prescribed thickness on the rear surface side of the sheet in which the pattern of suction grooves 50 and 60 and the ribs 54, 56 and 66, and the like, is formed as illustrated in FIGS. 4 to 6. The smaller the thickness of the flow channel groove forming layer 20B, the higher the suction force that can be obtained with a smaller negative pressure, but if the thickness is excessively small, then blockages due to foreign material, such as paper dust or other dirt, are liable to occur. If conditions of this kind are considered, then the thickness of the flow channel groove forming layer 20B is desirably 0.05 mm to 0.5 mm approximately.

The suction aperture forming layer 20A in the suction sheet 20 is required to have a thickness that ensures sufficient rigidity to avoid depression due to the suction pressure in the portions where the ribs 54, 56 and 66 are not present therebelow, and in order to wrap and hold the suction sheet 20 about the circumferential surface of the drum main body 30, corresponding flexibility is required. For instance, desirably, the thickness of the suction aperture forming layer 20A in a suction sheet 20 fabricated from stainless steel is 0.1 mm to 0.5 mm, more desirably 0.2 mm to 0.3 mm, approximately.

If a material other than stainless steel is used, then a suitable thickness should be determined by taking account of the rigidity and flexibility of the material used.

Figure 9:
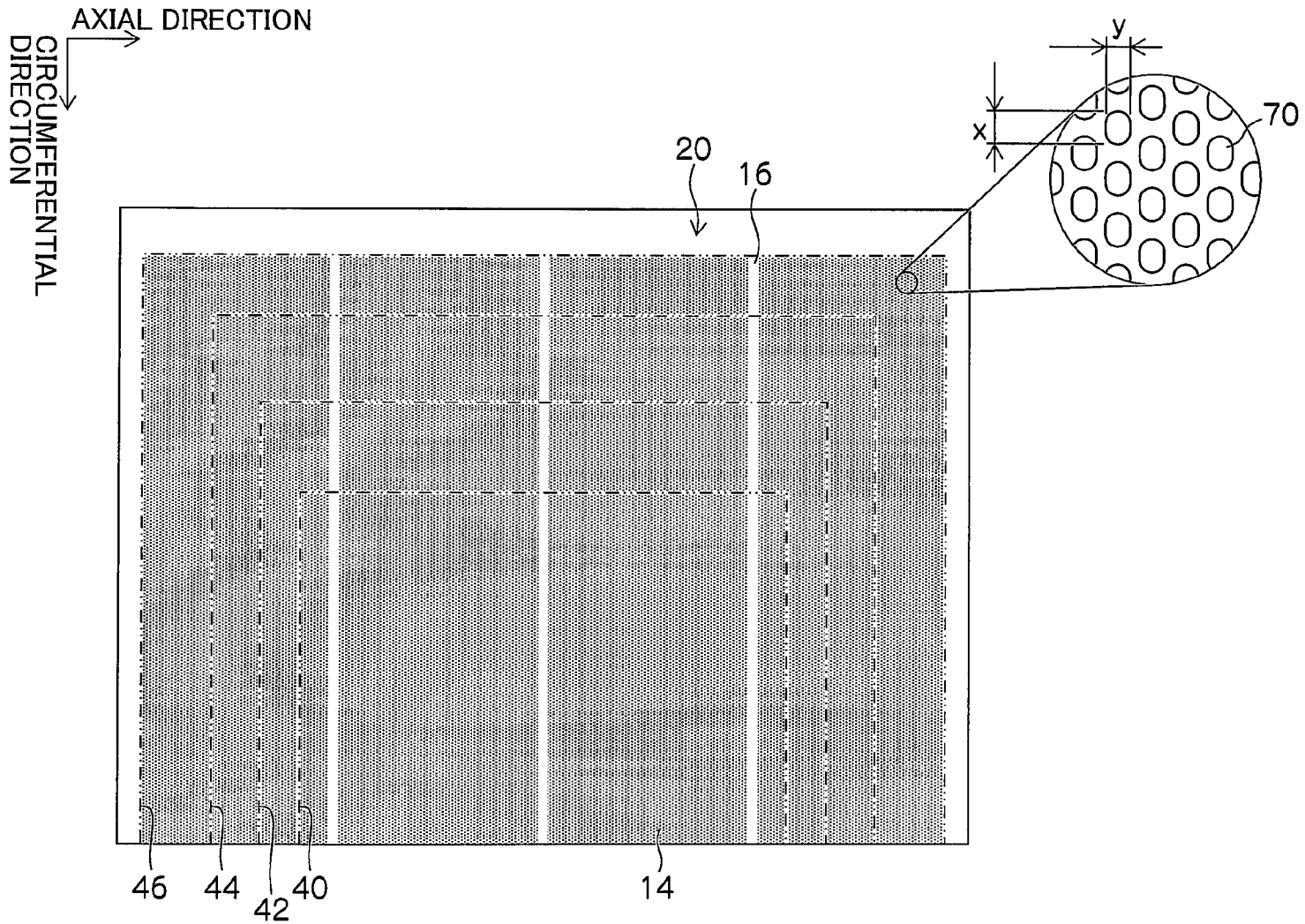
FIG. 9 is a plan diagram of the front surface of a suction sheet.

FIG. 9 is a plan diagram of the front surface (medium holding surface) of the suction sheet 20. As shown in FIG. 9, the suction apertures 70 are arranged in accordance with a prescribed arrangement pattern in the medium suction regions 14 of the suction sheet 20. Moreover, the suction sheet 20 is composed by forming the portions corresponding to the restrictor sections 52 and 62 on the rear surface side (see FIGS. 4 to 6) as the closed portions 16, where suction apertures are not provided, and consequently, the flow volume restricting function of the restrictor sections 52 and 62 is ensured. Furthermore, by providing the plurality of suction apertures 70 in the portions other than the closed portions 16 of the suction sheet 20, it is possible to use the suction sheet 20 of the same shape without having to change the pattern of suction apertures, with respect to a plurality of different paper sizes.

In other words, even if some of the suction apertures 70 (and the suction grooves 50 and 60) become opened to the air due to the size of the recording medium 114 used, it is still possible to restrict the loss of suction pressure due to the action of the restrictor sections 52 and 62, and therefore it is not necessary to close off the suction apertures 70 which do not contribute to holding the recording medium 114 by suction and there is no need to change the pattern of the suction apertures in accordance with recording media 114 of a large variety of sizes.

The present embodiment describes a mode where the number and arrangement configuration of the drum suction grooves 26 arranged in the half circumference (divided region) of the drum main body 30 are such that the drum suction grooves 26 are arranged in five rows at different positions in the drum axial direction (the center, both ends, and intermediate positions between these), each of the grooves being divided in two in the circumferential direction at each position (in each row), to obtain ten drum suction grooves 26 (see FIGS. 3 and 4), but there are no particular limitations on the number and arrangement configuration of the drum suction grooves 26.

It is also possible to cover the half circumference portion of the drum main body 30 with one drum suction groove, or to cover the half circumference portion of the drum main body 30 with two or more drum suction grooves. Depending on the required suction pressure and the capacity of the vacuum pump, it may be possible to cover one half circumference portion of the drum main body 30 with a single drum suction groove. However, taking account of the suction efficiency, it is desirable to employ a structure which covers the half circumference portion of the drum main body 30 by means of at least two drum suction grooves.

In FIG. 9, the suction apertures 70 are arranged in the staggered matrix arrangement so as to dispose the plurality of suction apertures 70 at high density. Of course, it is also possible to adopt an arrangement pattern other than the staggered matrix pattern for the arrangement of the suction apertures 70.

In a state where the recording medium 114 is held by suction on the conveyance drum 10 (see FIG. 2), the amount of deformation of the recording medium 114 due to the suction pressure is greater in the axial direction of the conveyance drum 10 than in the circumferential direction. Therefore, desirably, the suction apertures 70 are formed with an elliptical or elongated oval shape having the major axis in the circumferential direction and the minor axis in the axial direction, in such a manner that the recording medium 114 deforms by an equal amount in the circumferential direction and in the axial direction.

In FIG. 9, each suction aperture 70 is of an elongated oval shape having the major axis length x of 2 mm and the minor axis length y of 1.5 mm. It is desirable that the ratio of "y/x" between the major axis length x and the minor axis length y of the suction apertures 70 having an elongated oval shape is not smaller than 0.5 and not larger than 1.0, and more desirably, not smaller than 0.7 and not larger than 0.9.

Figure 10:
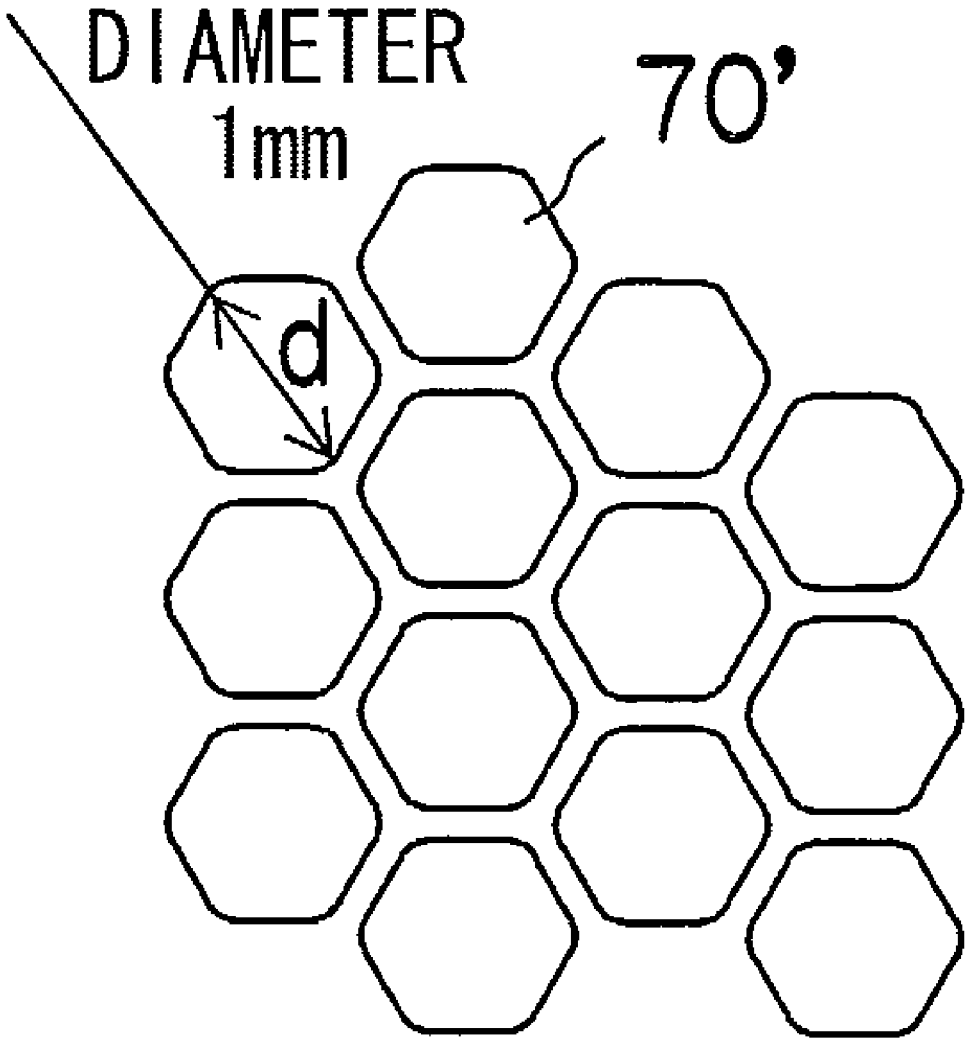
FIG. 10 is a diagram showing a further mode of suction apertures formed in the suction sheet.

As shown in FIG. 10, it is also desirable that the shape of the openings (the shape of suction apertures 70') is a polygonal shape, such as a hexagonal shape, in order to increase the opening ratio of the suction sheet 20. More specifically, since the suction force can be represented by "(opening surface area)×(pressure per unit surface area)", then by increasing the opening ratio, it is possible further to increase the suction force. However, if the opening surface area becomes too large, then depression of the suction sheet 20 and depression of the recording medium 114 become a problem, and therefore it is desirable to adopt a structure which leaves boundary portions between adjacent suction apertures 70', so as to guarantee the rigidity of the suction sheet 20.

Considering these conditions, a desirable shape for the suction apertures 70' (or 70) is a hexagonal shape in which the length d of the diagonal (the longest diagonal) is approximately 1 mm. Moreover, if the suction apertures 70' (or 70) have an angled (sharp angled) shape, then stress is concentrated in the corner sections, and therefore it is desirable that the corners should be given a rounded shape.

Mechanism for Holding Leading End Portion of the Recording Medium

Figure 11:
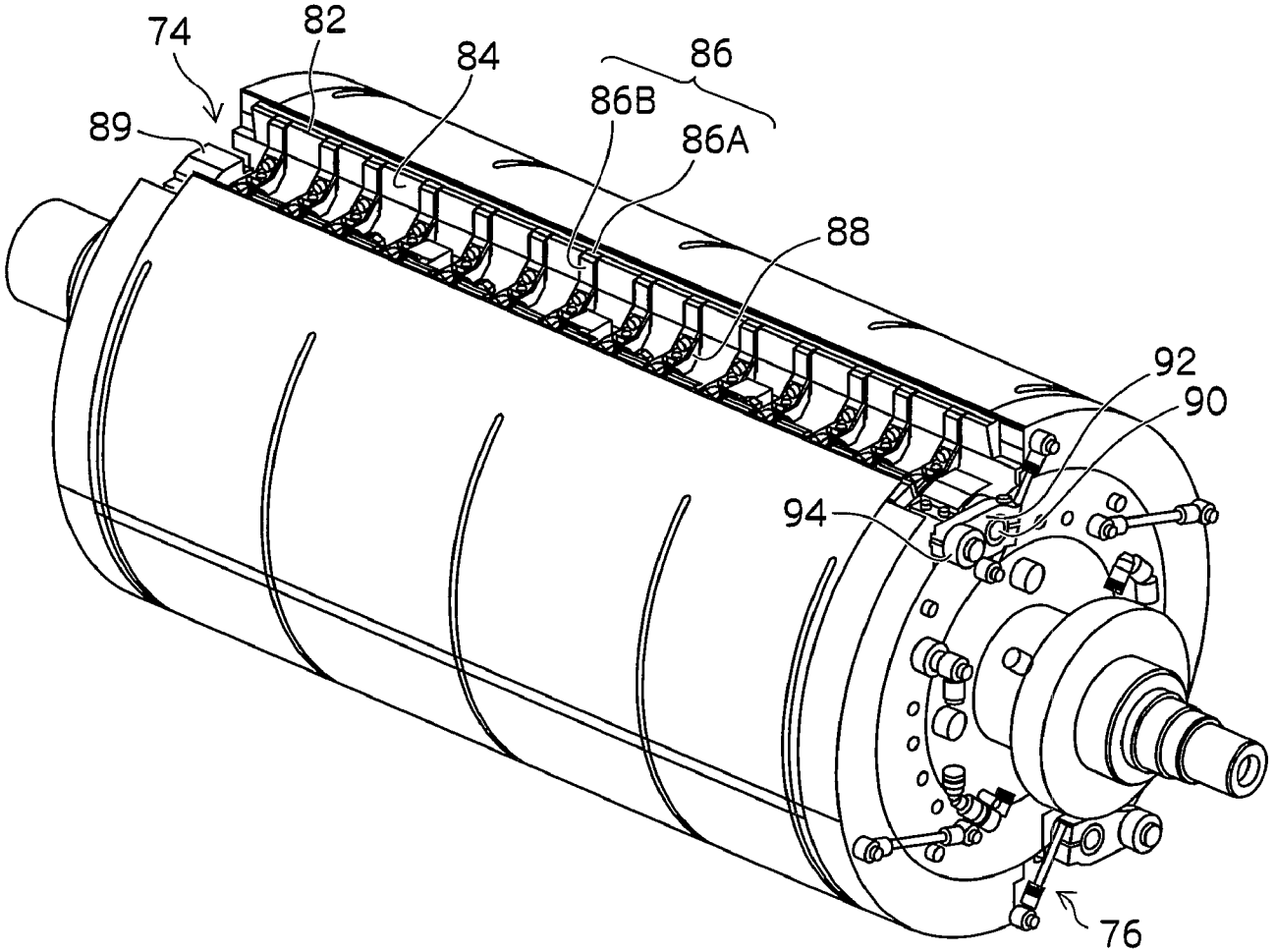
FIG. 11 is a perspective diagram showing a gripper section in a conveyance drum.

FIG. 11 is a perspective diagram of the paper gripper section in the conveyance drum 10. As shown in FIG. 11, two recess sections 74 and 76 are arranged in the conveyance drum 10 at symmetrical positions on either side of the rotational axle. It is also possible to use a mode in which three recess sections are provided at three equidistant positions on the outer circumferential surface of the drum (positions whereby the angle between the respective recess sections is)120°. Since the structures inside the recess sections 74 and 76 are the same, then only the structure of the recess section 74 is described, and description of the recess section 76 is omitted.

To the recess section 74, a paper leading end guide 84 having an end portion holding surface 82 on which the leading end portion of the recording medium (see FIG. 1) is held is arranged in the lengthwise direction of the conveyance drum 10, and furthermore, a plurality of grippers 86 which grip and hold the leading end portion of the recording medium are arranged at prescribed intervals in the lengthwise direction of the conveyance drum 10 (at equidistant intervals in the embodiment in FIG. 11), between the paper leading end guide 84 and the end portion holding surface 82.

The gripper 86 has an approximate L shape and secures the leading end portion of the recording medium by means of a hook 86A at the end of the gripper 86. A straight section (perpendicular portion) 86B of the gripper 86 is supported by a gripper base 88, and furthermore, the gripper base 88 is connected to a gripper driving (opening and closing) shaft 90, which is supported rotatably on a shaft bracket 89. The gripper driving shaft 90 is coupled to a cam follower 94 through a gripper driving arm 92.

The gripper 86 is constituted so as to make contact with and separate from the end fixing surface 82 (to perform an opening and closing operation), in accordance with the driving of a cam (not shown), by means of the transmission mechanism having the composition described above.

The paper leading end guide 84 also functions as a structural body which grips the suction sheet 20 that is wrapped about the outer circumferential surface of the conveyance drum 10, against the drum main body 30. Furthermore, the paper leading end guide 84 is arranged at a position where the upper surface of the gripper 83 that grips the recording medium does not project over the image forming surface of the recording medium when the recording medium is held on the outer circumferential surface of the conveyance drum 10.

Configuration of Print Unit

Next, the structure of the ink heads 140C, 140M, 140Y, 140K, 140R, 140G and 140B disposed in the print unit 108 in FIG. 1 is described in detail. The ink heads 140C, 140M, 140Y, 140K, 140R, 140G and 140B have a common structure, and in the following description, these heads are represented by an ink head (hereinafter, simply called a "head") denoted with reference numeral 160.

Figure 12A:
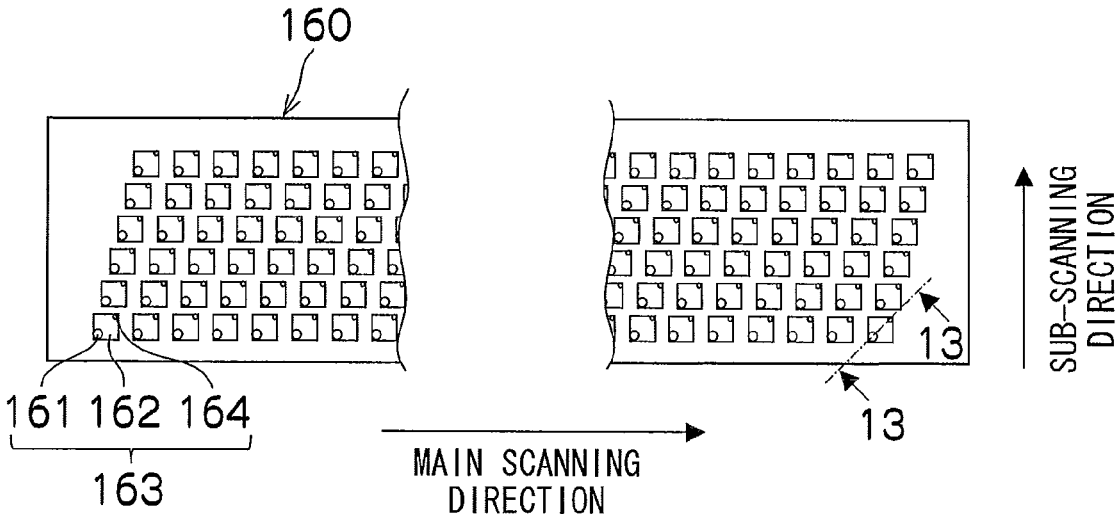
FIGS. 12A to 12C are plan view perspective diagrams showing examples of the inkjet head.
Figure 12B:
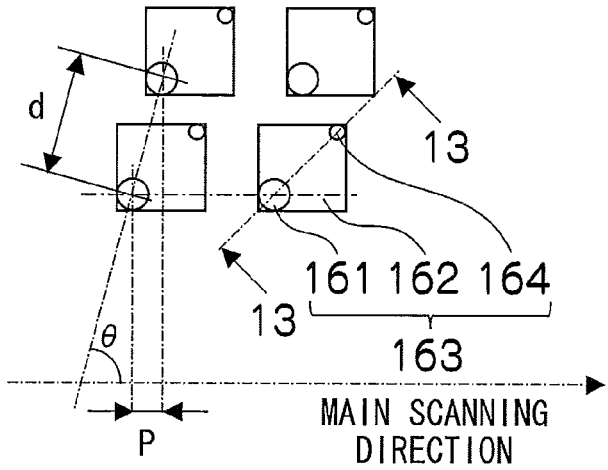
Figure 12C:
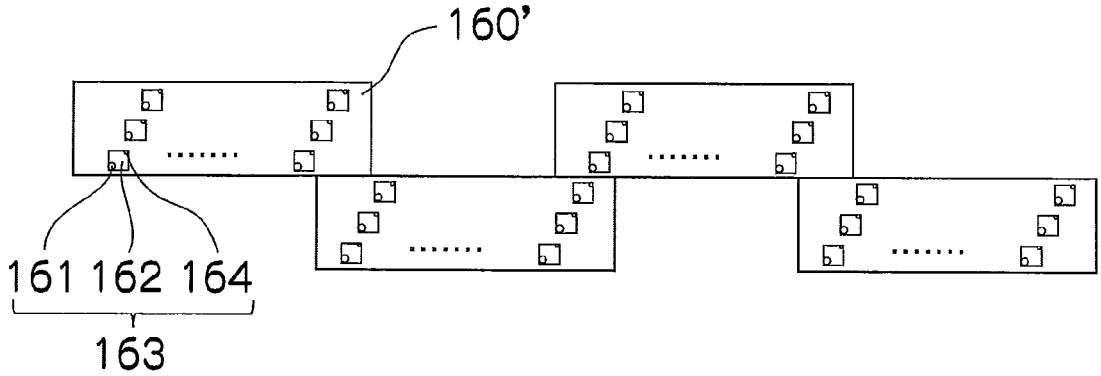
Figure 13:
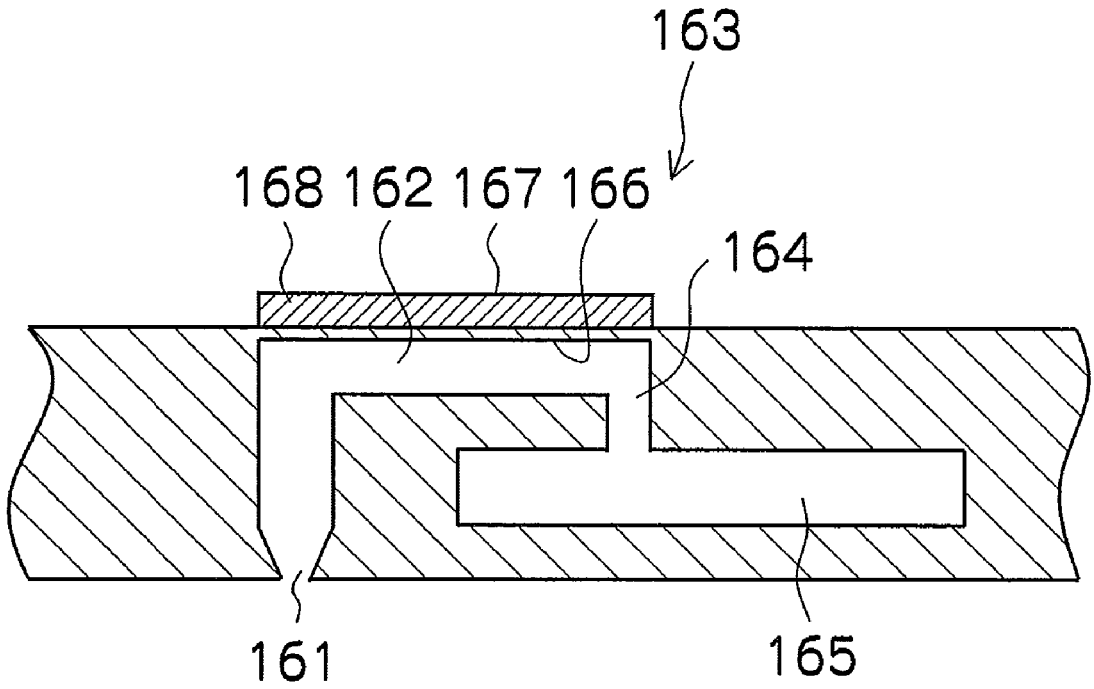
FIG. 13 is a cross-sectional diagram along line 13-13 in FIGS. 12A and 12B.

FIG. 12A is a plan view perspective diagram showing an embodiment of the structure of the head 160; FIG. 12B is an enlarged diagram showing a portion of the head; and FIG. 12C is a plan view perspective diagram showing a further embodiment of the structure of the head 160. FIG. 13 is a cross-sectional diagram along line 13-13 in FIGS. 12A and 12B, and shows the three-dimensional composition of an ink chamber unit (of one channel) as a unit of recording element.

As shown in FIGS. 12A and 12B, the head 160 according to the present embodiment has a structure in which a plurality of ink chamber units 163, each having a nozzle 161 forming an ink droplet ejection port, a pressure chamber 162 corresponding to the nozzle 161, and the like, are disposed two-dimensionally in the form of a staggered matrix, and hence the effective nozzle interval (the projected nozzle pitch) as projected in the lengthwise direction of the head (the main-scanning direction perpendicular to the recording medium conveyance direction (sub-scanning direction)) is reduced and high nozzle density is achieved.

The mode of forming one or more nozzle rows through a length corresponding to the entire width of the recording area of the recording medium 114 in a direction substantially perpendicular to the conveyance direction of the recording medium 114 is not limited to the embodiment described above. For example, instead of the configuration in FIG. 12A, as shown in FIG. 12C, a line head having the nozzle rows of the length corresponding to the entire width of the recording area of the recording medium 114 can be formed by arranging and combining, in a staggered matrix, short head blocks 160' each having a plurality of nozzles 161 arrayed two-dimensionally. Furthermore, although not shown in the drawings, it is also possible to compose a line head by arranging short heads in one row.

The pressure chamber 162 provided corresponding to each of the nozzles 161 is approximately square-shaped in plan view, and an outlet port connecting to the nozzle 161 and an ink inlet port (ink supply port) 164 are disposed in both corners on a diagonal line of the square. The shape of the pressure chamber 162 is not limited to that of the present embodiment, and a variety of planar shapes, for example, a polygon such as a quadrilateral (rhomb, rectangle, etc.), a pentagon and a heptagon, a circle, and an ellipse can be employed.

Each pressure chamber 152 is connected to a common channel 155 through the supply port 154. The common channel 155 is connected to an ink tank (not shown), which is a base tank for supplying ink, and the ink supplied from the ink tank is delivered through the common flow channel 155 to the pressure chambers 152.

A piezoelectric element 168 provided with an individual electrode 167 is bonded to a diaphragm 166, which forms a face (the upper face in FIG. 13) of the pressure chamber 162 and also serves as a common electrode, and the piezoelectric element 168 is deformed when a drive voltage is applied to the individual electrode 167, thereby causing the ink to be ejected from the nozzle 161. When the ink is ejected, new ink is supplied to the pressure chamber 162 from the common flow passage 165 through the supply port 164.

In the present embodiment, the piezoelectric element 168 is used as an ink ejection force generating device, which causes the ink to be ejected from the nozzle 160 in the head 161; however, it is also possible to employ a thermal method in which a heater is provided inside the pressure chamber 162 and the ink is ejected by using the pressure of the film boiling action caused by the heating action of this heater.

As shown in FIG. 12B, the high-density nozzle arrangement according to the present embodiment is achieved by arranging the plurality of ink chamber units 163 having the above-described structure in a lattice fashion based on a fixed arrangement pattern, in a row direction that coincides with the main scanning direction, and a column direction that is inclined at a fixed angle of θ with respect to the main scanning direction, rather than being perpendicular to the main scanning direction.

More specifically, by adopting the structure in which the plurality of ink chamber units 163 are arranged at the uniform pitch d in line with the direction forming the angle of θ with respect to the main scanning direction, the pitch P of the nozzles projected so as to align in the main scanning direction is d×cos θ, and hence the nozzles 161 can be regarded to be equivalent to those arranged linearly at the fixed pitch P along the main scanning direction.

Furthermore, the scope of application of the present invention is not limited to a printing system based on the line type of head, and it is also possible to adopt a serial system where a short head that is shorter than the breadthways dimension of the recording medium 114 is moved in the breadthways direction (main scanning direction) of the recording medium 114, thereby performing printing in the breadthways direction, and when one printing action in the breadthways direction has been completed, the recording medium 114 is moved through a prescribed amount in the sub-scanning direction perpendicular to the breadthways direction, printing in the breadthways direction of the recording medium 114 is carried out in the next printing region, and by repeating this sequence, printing is performed over the whole surface of the printing region of the recording medium 114.

Description of Control System

Figure 14:
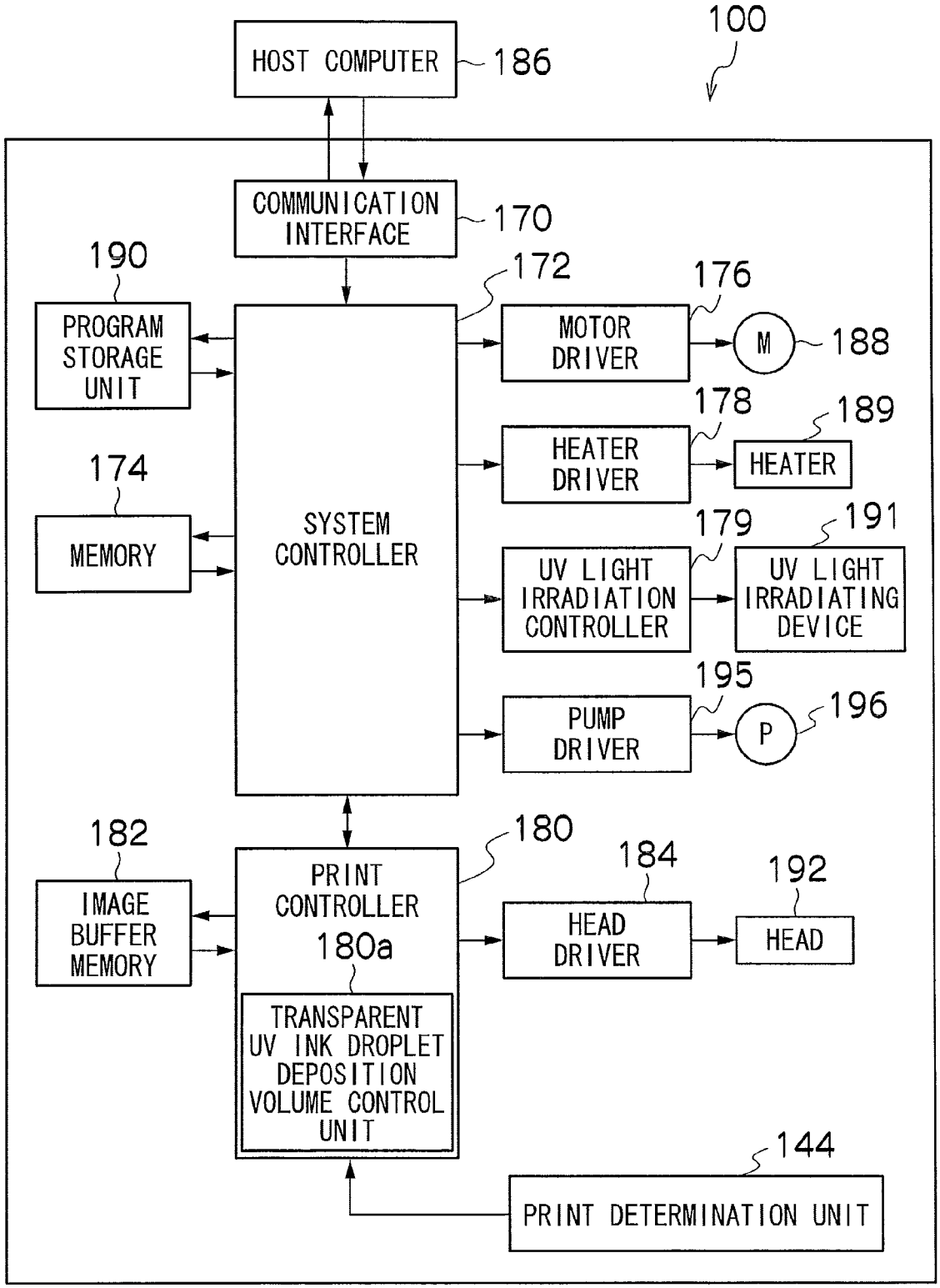
FIG. 14 is a principal block diagram showing the system configuration of the inkjet recording apparatus shown in FIG. 1.

FIG. 14 is a principal block diagram showing the system configuration of the inkjet recording apparatus 100. The inkjet recording apparatus 100 includes a communication interface 170, a system controller 172, a memory 174, a motor driver 176, a heater driver 178, a UV light irradiation controller 179, a print controller 180, an image buffer memory 182, a head driver 184, a program storage unit 190, a pump driver 195, and the like.

The communication interface 170 is an interface unit serving as an image receiving device for receiving image data sent from a host computer 186. A serial interface such as USB (Universal Serial Bus), IEEE1394, Ethernet, wireless network, or a parallel interface such as a Centronics interface may be used as the communication interface 176. A buffer memory (not shown) may be mounted in this portion in order to increase the communication speed. The image data sent from the host computer 186 is received by the inkjet recording apparatus 100 through the communication interface 170, and is temporarily stored in the memory 174.

The memory 174 is a storage device for temporarily storing image data inputted through the communication interface 170, and data is written and read to and from the memory 174 through the system controller 172. The memory 174 is not limited to a memory composed of semiconductor elements, and a hard disk drive or another magnetic medium may be used.

The system controller 172 is constituted of a central processing unit (CPU) and peripheral circuits thereof, and the like, and it functions as a control device for controlling the whole of the inkjet recording apparatus 100 in accordance with a prescribed program, as well as a calculation device for performing various calculations. More specifically, the system controller 172 controls the various sections, such as the communication interface 170, memory 174, motor driver 176, heater driver 178, and the like, as well as controlling communications with the host computer 186 and writing and reading to and from the memory 174, and it also generates control signals for controlling a motor 188, a heater 189 and a vacuum pump 196 of the conveyance system.

The program executed by the CPU of the system controller 172 and the various types of data which are required for control procedures are stored in the memory 174. The memory 174 may be a non-rewriteable storage device, or it may be a rewriteable storage device, such as an EEPROM. The memory 174 is used as a temporary storage region for the image data, and it is also used as a program development region and a calculation work region for the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. An external interface may be provided, and a memory card or PC card may also be used. Naturally, a plurality of these recording media may also be provided. The program storage unit 190 may also be combined with a storage device for storing operational parameters, and the like (not shown).

The motor driver 176 is a driver that drives the motor 188 in accordance with instructions from the system controller 177. In FIG. 14, the plurality of motors disposed in the respective sections of the inkjet recording apparatus 100 are represented by the reference numeral 188. For example, the motor 188 shown in FIG. 14 includes the motors that drive the pressure drums 126*a* to 126*d*, the transfer drums 124*a* to 124*d* and the paper output drum 150, shown in FIG. 1.

The heater driver 178 is a driver that drives the heater 189 in accordance with instructions from the system controller 172. In FIG. 14, the plurality of heaters disposed in the inkjet recording apparatus 100 are represented by the reference numeral 189. For example, the heater 189 shown in FIG. 14 includes the heaters of the paper preheating units 128 and 134, the permeation suppression agent drying unit 132, the treatment liquid drying unit 138, the solvent drying units 142*a* and 142*b*, and the like, shown in FIG. 1.

The UV light irradiation controller 179 controls the UV irradiation of a UV light irradiating device 191. In FIG. 14, the plurality of UV light irradiating devices disposed in the inkjet recording apparatus 100 are represented by the reference numeral 191. For example, the UV light irradiating device 191 shown in FIG. 14 includes the first UV light lamps 148*a* and 148*b* and the second UV lamp 156 shown in FIG. 1. The optimum irradiation time, irradiation interval and irradiation intensity of the UV lamps 148*a*, 148*b* and 156 are determined in advance for each type of recording medium 114 and each type of transparent UV ink, this information is stored in a prescribed memory (for example, the memory 174) in the form of a data table, and when the information about the recording medium 114 and the ink used is acquired, then the irradiation time, the irradiation interval and the irradiation intensity are accordingly controlled by referring to the memory.

The pump driver 195 controls the vacuum pump 196, which generates suction pressure for holding and securing the recording medium 114 to the pressure drums 126*a* to 126*d* (the conveyance drum 10 in FIG. 2). For example, in the inkjet recording apparatus 100 shown in FIG. 1, when the recording medium 114 of which prescribed processing has been finished reaches the pressure drum 126*c* of the print unit 108, the vacuum pump 196 connected to the vacuum flow channel of the pressure drum 126*c* is driven, and a vacuum (negative pressure) corresponding to the type, size and bending rigidity of the recording medium 114 is generated.

More specifically, when information about the type of recording medium 114 is acquired by the system controller 172, then this information about the recording medium 114 is sent to the pump driver 195. The pump driver 195 sets a suction pressure in accordance with the information about the recording medium 114 and controls the on and off switching and generated pressure of the vacuum pump 196 in accordance with this setting.

For example, if a recording medium 114 such as thin paper having lower bending rigidity than the standard bending rigidity is used, then the suction pressure is set to be lower than standard, whereas if a recording medium 114 such as thick paper having higher bending rigidity than the standard bending rigidity is used, then the suction pressure is set to be higher than standard. Furthermore, depending on the thickness of the recording medium 114, if a recording medium 114 having a greater thickness than the standard thickness is used, then a higher suction pressure than standard is set, and if a recording medium 114 having a smaller thickness than the standard thickness is used, then a lower suction pressure than standard is set. It is preferable that appropriate suction pressures are predetermined in association with the types (e.g., thicknesses and bending rigidities) of recording media 114, and this information is stored in a prescribed memory (for example, the memory 174 in FIG. 14) in the form of a data table.

FIG. 14 shows only one vacuum pump 196; however, it is possible to provide vacuum pumps respectively for the pressure drums 126*a* to 126*d*, or it is also possible to provide a single vacuum pump and a switching device such as a control valve arranged in the vacuum flow channel so as to connect the single vacuum pump selectively with one of the pressure drums 126*a* to 126*d*.

The print controller 180 has a signal processing function for performing various tasks, compensations, and other types of processing for generating print control signals from the image data stored in the memory 174 in accordance with commands from the system controller 172 so as to supply the generated print data (dot data) to the head driver 184. Prescribed signal processing is carried out in the print controller 180, and the ejection amount and the ejection timing of the ink droplets from the respective print heads 192 are controlled through the head driver 184, on the basis of the print data. By this means, desired dot size and dot positions can be achieved. In FIG. 14, the plurality of heads (inkjet heads) disposed in the inkjet recording apparatus 100 are represented by the reference numeral 192. For example, the head 192 shown in FIG. 14 includes the permeation suppression agent head 130, the treatment liquid head 136, the ink heads 140C, 140M, 140Y, 140K, 140R, 140G and 140B, and the transparent UV ink head 146, shown in FIG. 1.

The print controller 180 is provided with a transparent UV ink droplet deposition volume control unit 180*a*, which controls the liquid droplet volume ejected from the transparent UV ink head 146 shown in FIG. 1. The transparent UV ink droplet deposition volume control unit 180*a* controls the liquid droplet volume ejected from the transparent UV ink head 146 through the head driver 184, in such a manner that the thickness of the layer of transparent UV ink deposited over the colored inks on the recording medium 114 is not greater than 5 μm (desirably not greater than 3 μm, and more desirably, not smaller than 1 μm and not greater than 3 μm).

The print controller 180 is also provided with an image buffer memory 182; and image data, parameters, and other data are temporarily stored in the image buffer memory 182 when image data is processed in the print controller 180. Also possible is an aspect in which the print controller 180 and the system controller 172 are integrated to form a single processor.

The head driver 184 generates drive signals to be applied to the piezoelectric elements 168 of the head 192, on the basis of image data supplied from the print controller 180, and includes drive circuits which drive the piezoelectric elements 168 by applying the drive signals to the piezoelectric elements 168. A feedback control system for maintaining constant drive conditions in the head 192 may be included in the head driver 184 illustrated in FIG. 14.

The print determination unit 144 is a block that includes a line sensor as described above with reference to FIG. 1, reads the image printed on the recording medium 114, determines the print conditions (presence of the ejection, variation in the dot formation, and the like) by performing prescribed signal processing, or the like, and provides the determination results of the print conditions to the print controller 180.

The print controller 182 makes various corrections according to requirements with respect to the head 192 and cleaning operations (restoration operations of the nozzles) such as preliminary ejection, suction, and wiping for the head 192, on the basis of information obtained from the print determination unit 144.

According to the inkjet recording apparatus 100 having the composition described above, the suction apertures 70 are arranged in the circumferential surface (medium holding surface 13) of the pressure drums 126*a* to 126*d* (conveyance drum 10) which convey the recording medium 114 in a prescribed direction while holding the recording medium, and the restrictor sections 52 and 62 having the groove widths smaller than the groove widths of the other portions are provided in the suction grooves 50 and 60 which connect to the suction apertures 70, and by applying the suction pressure to the recording medium 114 through the restrictor sections 52 and 62, the suction grooves 50 and 60 and the suction apertures 70, it is possible to raise the suction force acting on the recording medium 114 yet further and hence it is possible to hold the recording medium 114 in tight contact with the conveyance drum 10, even when using a stiff medium, such as thick paper.

Moreover, since the arrangement pattern of the suction grooves 50 and 60 is designed in accordance with the sizes of the recording media 114 used, then it is possible to achieve compatibility with recording media 114 of a plurality of sizes without having to make mechanical changes, and furthermore, control is not necessary for switching the vacuum flow channels, and the like, when changing the size of the recording medium 114.

Furthermore, according to the present embodiment, since the ribs 54 and 56 are arranged inside the broad-width suction grooves 50 through which the trailing end portion of the paper is held by suction, then it is possible to prevent indented deformation of the suction sheet 20 and a uniform throw distance can be maintained.

Modification Embodiment 1

The description given above relates to an embodiment of a single unified suction sheet in which suction apertures 70 are formed in one surface of a single suction sheet 20, and suction grooves 50 and 60, restrictor sections 52 and 62 and ribs 54, 56 and 66 are formed in the other surface of the single suction sheet 20, but the implementation of the present invention is not limited to this example.

For example, it is possible to adopt a mode in which a first sheet corresponding to the suction aperture forming layer 20A and a second sheet (intermediate sheet) corresponding to the flow channel groove forming layer 20B are prepared separately and are then stacked together.

Modification Embodiment 2

In the embodiment described above, suction grooves (50 and 60) are formed in the rear surface side of the suction sheet 20, but it is also possible to adopt a mode where suction grooves are formed in the front surface side (the medium holding surface side which makes contact with the recording medium). For example, it is also possible to employ a mode in which the suction aperture forming layer 20A shown in FIG. 8 is omitted and the suction grooves (50 and 60) are exposed on the medium holding surface. In this case, it is desirable that the upper face of the restrictor sections 52 and 62 is closed off.

Modification Embodiment 3

As in the embodiment described above, the present invention is effective in a drum-shaped (rotating body-shaped) medium holding apparatus, such as a pressure drum, but the range of application of the present invention is not limited to this and may also be applied to a linear motion system, such as a belt-shaped member or a flat bed type of medium holding apparatus.

Modification Embodiment 4

In the embodiment described above, a case has been given where the suction force to the trailing end portion of the paper is strengthened, but a similar composition can also be applied to other end portions apart from the trailing end portion, for instance, the leading end portion or the lateral end portions of the paper.

Modification Embodiment 5

In the embodiment described above, the inkjet recording apparatus 100 has been described which uses transparent UV ink (ultraviolet-curable ink) after printing with colored inks, but instead of this, it is also possible to adopt a mode which includes a drying unit, such as an IR heater or ventilation device, and a fixing unit such as a fixing roller, or the like. Furthermore, the present invention is not limited to a single-side printing machine which prints an image onto one surface of a recording medium, and may also be applied to a double-side printing machine which records images onto both surfaces of a recording medium. For example, a double-side printing machine is obtained by adding a mechanism for inverting the recording medium after single-surface recording, after the transparent UV ink deposition unit 110 in the inkjet recording apparatus shown in FIG. 1, and adding a composition for carrying out permeation suppression processing, treatment liquid deposition, ink droplet ejection (printing), and transparent UV ink deposition (namely, a composition similar to that indicated by reference numerals 104 to 110 in FIG. 1), onto the inverted recording medium (onto the rear surface side of the recording medium).

Example of Application to Other Apparatus Compositions

In the embodiment described above, the inkjet recording apparatus has been described as an example of an image forming apparatus, but the scope of application of the present invention is not limited to this, and may also be applied to an image forming apparatus based on a method other than an inkjet method, such as a laser recording method or electrophotographic method, or the like. For example, it is also possible to apply the present invention to color image recording apparatuses of various types, such as a thermal transfer recording apparatus equipped with a recording head that uses thermal elements as recording elements, an LED electrophotographic printer equipped with a recording head having LED elements as recording elements, or a silver halide photographic printer having an LED line type exposure head, or the like.

Furthermore, the meaning of the term "image forming apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, or the like.

Appendix

As has become evident from the detailed description of the embodiments given above, the present specification includes disclosure of various technical ideas described below.

For example, a medium holding apparatus includes: a medium holding device having a plurality of suction grooves through which a sheet-shaped medium is held by suction; and a suction pressure generating device which is connected to the suction grooves and generates a suction pressure in each of the suction grooves, wherein the suction pressure in one of the suction grooves that holds a first end portion of the sheet-shaped medium is made stronger than the suction pressure in one of the suction grooves that holds a central portion of the sheet-shaped medium.

The present invention can be applied to sheet-shaped media of various types and materials, such as paper, resin sheets, metal sheets, and the like. For example, even if using thick paper or stiff media, it is possible to hold the media with a strong suction pressure.

It is preferable that a flow volume per unit length in one of the suction grooves that is in a position where the first end portion of the sheet-shaped medium is held is greater than a flow volume per unit length in one of the suction grooves that is in a position where the central portion of the sheet-shaped medium is held.

According to this aspect of the present invention, it is possible to make the suction pressure in the suction grooves corresponding to the end portions of the medium greater than in the other suction grooves (the suction grooves corresponding to the central portion of the medium), and the end portions of a stiff medium can be prevented from becoming detached from the medium holding surface.

It is also preferable that a width of one of the suction grooves that is in a position where the first end portion of the sheet-shaped medium is held is greater than a width of one of the suction grooves that is in a position where the central portion of the sheet-shaped medium is held.

According to this aspect of the present invention, it is possible to increase the suction flow volume in the suction grooves through which the end portion of the medium is held by suction, with respect to the other suction grooves (the suction grooves corresponding to the central portion of the medium), and hence a stiff medium can be held.

It is also preferable that the suction grooves are connected to the suction pressure generating device respectively through restrictor sections with which a flow volume in each of the suction grooves is restricted; and a cross-sectional area of the restrictor section of one of the suction grooves that is in a position where the first end portion of the sheet-shaped medium is held is greater than a cross-sectional area of the restrictor section of one of the suction grooves that is in a position where the central portion of the sheet-shaped medium is held.

According to this aspect of the present invention, it is possible to increase the flow volume in the suction grooves through which the end portion of the medium is held by suction, and therefore a stiff paper can be held.

The restrictor sections are of a structure having a function of restricting the suction pressure (negative pressure) applied to the medium, and a desirable mode is one where each restrictor section is disposed in one end portion of each of the suction grooves. For example, the restrictor sections are composed by forming flow channel sections of narrow width in such a manner that the width of one end portion of each suction groove becomes narrower than the other portions thereof. One restrictor section may be provided to correspond to one suction groove, or a common restrictor section may be provided for a plurality of suction grooves.

It is also preferable that the suction grooves are connected to the suction pressure generating device respectively through restrictor sections with which a flow volume in each of the suction grooves is restricted; and a length of the restrictor section of one of the suction grooves that is in a position where the first end portion of the sheet-shaped medium is held is shorter than a length of the restrictor section of one of the suction grooves that is in a position where the central portion of the sheet-shaped medium is held.

According to this aspect of the present invention, it is also possible to increase the flow volume in the suction grooves through which the end portion of the medium is held by suction, and therefore a stiff paper can be held.

It is also preferable that a length of one of the suction grooves that is in a position where the first end portion of the sheet-shaped medium is held is shorter than a length of one of the suction grooves that is in a position where the central portion of the sheet-shaped medium is held.

According to this aspect of the present invention, it is possible to increase the flow volume in the suction grooves through which the end portion of the medium is held by suction, and therefore a stiff paper can be held.

It is also preferable that one of the suction grooves that is in a position where the first end portion of the sheet-shaped medium is held has a rib therein.

According to this aspect of the present invention, it is possible to suppress indented deformation of the medium during suction. Desirably, the height of the ribs which are erected inside the suction grooves is substantially equal to the depth of the suction grooves. It is possible to design the height of the ribs which enables an uneven deformation of the medium surface within an acceptable range.

It is also preferable that one of the suction grooves that is in a position where the first end portion of the sheet-shaped medium is held has a plurality of island-shaped ribs therein.

A desirable mode is one in which a plurality of ribs are provided in the breadthways direction of the suction grooves, as the breadth of the suction grooves becomes greater. Furthermore, a desirable mode is one in which a plurality of ribs are provided in the lengthwise direction of the suction grooves, as the length of the suction grooves becomes greater.

It is also preferable that one of the suction grooves that is in a position where the first end portion of the sheet-shaped medium is held has a plurality of island-shaped first ribs and a plurality of island-shaped second ribs therein; the first ribs are arranged separately from each other along a line parallel with a lengthwise direction of the one of the suction grooves; and the second ribs are arranged separately from each other along a line perpendicular to the lengthwise direction in interspace between the first ribs.

According to this aspect of the present invention, it is possible to suppress indented deformation of the medium during suction, as well as being able to increase the sucking flow volume.

It is also preferable that the medium holding device has a drum shape which holds the sheet-shaped medium by suction on a circumferential surface thereof.

In the case of a mode where a sheet-shaped medium is bent and held about the circumferential surface of the drum (curved surface), there is a problem in that the medium is liable to float up from the circumferential surface of the drum (the medium holding surface) due to the forces seeking to return the medium to its original state, but this aspect of the present invention is effective in respect of floating up of this kind.

It is also preferable that the medium holding device includes a gripper which grips a leading end portion of the sheet-shaped medium; and the first end portion of the sheet-shaped medium includes a trailing end portion of the sheet-shaped medium.

According to this aspect of the present invention, it is possible to prevent detachment of the trailing end portion of the medium.

It is also preferable that the medium holding device includes a sheet-shaped member and a main body; the suction grooves are arranged in the sheet-shaped member; the main body has suction flow channels connecting to the suction grooves; and the sheet-shaped member is superimposed on the main body portion.

By adopting a structure in which suction grooves constituting sucking flow channels are formed in a sheet-shaped member and this sheet-shaped member is superimposed over a main body portion of the medium holding device, it is possible readily to form a complicated three-dimensional structure which includes the suction flow channels connected to the suction pressure generating device.

It is also preferable that the sheet-shaped member has a front surface on which the sheet-shaped medium is held and a rear surface which is in contact with the main body; the suction grooves are arranged in the rear surface of the sheet-shaped member; and the sheet-shaped member has a plurality of suction apertures in the front surface thereof, the suction apertures connecting to the suction grooves.

It is also preferable that the suction grooves are disposed according to an arrangement pattern which corresponds to a plurality of different medium sizes capable of being held on a medium holding surface of the medium holding device.

According to this aspect of the present invention, there is no need to carry out switching of the suction pressure flow channels in accordance with media of different sizes, and the like, and therefore the apparatus composition is simplified.

It is also preferable that an image forming apparatus includes: the above-described medium holding apparatus; and a recording head which carries out image recording onto the sheet-shaped medium.

According to this aspect of the present invention, it is possible to hold various media, including media of high stiffness, on the medium holding surface of the medium holding device, and high-quality image formation is possible.

The inkjet recording apparatus which is one mode of the image forming apparatus according to the present invention includes: a liquid ejection head (recording head) in which a plurality of liquid droplet ejection elements are arranged at high density, each liquid droplet ejection element having a nozzle (ejection port) for ejecting an ink droplet in order to form a dot and a pressure generating device (piezoelectric element or heating element for heating for bubble generation)

which generates an ejection pressure; and an ejection control device which controls the ejection of liquid droplets from the liquid ejection head on the basis of ink ejection data (dot image data) generated from an input image. An image is formed on a recording medium by means of the liquid droplets ejected from the nozzles.

For example, color conversion and halftone processing are carried out on the basis of the image data (print data) input through the image input device, and ink ejection data corresponding to the ink colors is generated. The driving of the pressure generating elements corresponding to the respective nozzles of the liquid ejection head is controlled on the basis of this ink ejection data, and ink droplets are ejected from the nozzles.

In order to achieve high-resolution image output, a desirable mode is one using a recording head in which a large number of liquid droplet ejection elements (ink chamber units) are arranged at high density, each liquid droplet ejection element having a nozzle (ejection port) which ejects ink liquid, a pressure chamber corresponding to the nozzle, and a pressure generating device.

A compositional example of a recording head based on an inkjet method of this kind is a full line type head having a nozzle row in which a plurality of ejection ports (nozzles) are arranged through a length corresponding to the full width of the recording medium. In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type head is usually disposed in a direction that is perpendicular to the relative feed direction (relative conveyance direction) of the recording medium, but a mode may also be adopted in which the head is disposed following an oblique direction that forms a prescribed angle with respect to the direction perpendicular to the conveyance direction.

The conveyance device for causing the recording medium and the recording head to move relative to each other may include a mode where the recording medium is conveyed with respect to a stationary (fixed) head, or a mode where a head is moved with respect to a stationary recording medium, or a mode where both the head and the recording medium are moved. When forming color images by means of an inkjet recording head, it is possible to provide a recording head for each color of a plurality of colored inks (recording liquids), or it is possible to eject inks of a plurality of colors, from one recording head.

The term "recording medium" includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

Possible modes of the conveyance device are a conveyance drum (conveyance roller) having a cylindrical shape which is able to rotate about a prescribed rotational axis, or a conveyance belt, or the like. The medium holding apparatus according to the present invention can be used as a recording medium holding device in such a conveyance device.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A medium holding apparatus, comprising:

a medium holding device having a plurality of suction grooves through which a recording medium is held by suction; and a suction pressure generating device which is connected to the suction grooves and generates a suction pressure in each of the suction grooves, wherein the medium holding device includes a medium holding body having a body suction groove connected to the suction pressure generating device, and a suction sheet having the plurality of suction grooves, wherein the suction sheet includes a lower layer and an upper layer provided on the lower layer, the lower layer contacts with the medium holding device and has the plurality of suction grooves and restrictor sections connected to the plurality of suction grooves, and the upper layer includes suction apertures, wherein the restrictor sections of the suction sheet are provided in positions corresponding to the body suction groove of the medium holding device, wherein a width of one of the suction grooves that is in a position where the first end portion of the recording medium is held is greater than a width of one of the suction grooves that is in a position where the central portion of the recording medium is held, wherein a length of one of the suction grooves that is in a position where the first end portion of the recording medium is held is shorter than a length of one of the suction grooves that is in a position where the central portion of the recording medium is held, and wherein the suction pressure in one of the suction grooves that holds a first end portion of the recording medium is made stronger than the suction pressure in one of the suction grooves that holds a central portion of the recording medium.

2. The medium holding apparatus as defined in claim 1, wherein a flow volume per unit length in one of the suction grooves that is in a position where the first end portion of the recording medium is held is greater than a flow volume per unit length in one of the suction grooves that is in a position where the central portion of the recording medium is held.

3. The medium holding apparatus as defined in claim 1, wherein:

the suction grooves are connected to the suction pressure generating device respectively through the restrictor sections with which a flow volume in each of the suction grooves is restricted; and a cross-sectional area of the restrictor section of one of the suction grooves that is in a position where the first end portion of the recording medium is held is greater than a cross-sectional area of the restrictor section of one of the suction grooves that is in a position where the central portion of the recording medium is held.

4. The medium holding apparatus as defined in claim 1, wherein:

the suction grooves are connected to the suction pressure generating device respectively through restrictor sections with which a flow volume in each of the suction grooves is restricted; and a length of the restrictor section of one of the suction grooves that is in a position where the first end portion of the recording medium is held is shorter than a length of the restrictor section of one of the suction grooves that is in a position where the central portion of the recording medium is held.

5. The medium holding apparatus as defined in claim 1, wherein one of the suction grooves that is in a position where the first end portion of the recording medium is held has a rib therein.

6. The medium holding apparatus as defined in claim 1, wherein one of the suction grooves that is in a position where the first end portion of the recording medium is held has a plurality of island-shaped ribs therein.

7. The medium holding apparatus as defined in claim 1, wherein:

one of the suction grooves that is in a position where the first end portion of the recording medium is held has a plurality of island-shaped first ribs and a plurality of island-shaped second ribs therein;

the first ribs are arranged separately from each other along a line parallel with a lengthwise direction of the one of the suction grooves; and the second ribs are arranged separately from each other along a line perpendicular to the lengthwise direction in interspace between the first ribs.

8. The medium holding apparatus as defined in claim 1, wherein the medium holding device has a drum shape which holds the recording medium by suction on a circumferential surface thereof.

9. The medium holding apparatus as defined in claim 1, wherein:

the medium holding device includes a gripper which grips a leading end portion of the recording medium; and the first end portion of the recording medium includes a trailing end portion of the recording medium.

10. The medium holding apparatus as defined in claim 1, wherein:

the medium holding body has suction flow channels connecting to the suction grooves; and the suction sheet is superimposed on the medium holding body.

11. The medium holding apparatus as defined in claim 10, wherein:

the suction apertures connect to the suction grooves.

12. The medium holding apparatus as defined in claim 1, wherein the suction grooves are disposed according to an arrangement pattern which corresponds to a plurality of different medium sizes capable of being held on a medium holding surface of the medium holding device.

13. An image forming apparatus, comprising:

the medium holding apparatus as defined in claim 1; and a recording head which carries out image recording onto the recording medium.

* * * * *